US007308222B2

(12) United States Patent
Nakagawa et al.

(10) Patent No.: US 7,308,222 B2
(45) Date of Patent: Dec. 11, 2007

(54) TONER SUPPLYING SYSTEM FOR AN IMAGE FORMING APPARATUS

(75) Inventors: Yoshinori Nakagawa, Yokohama (JP); Masanori Horike, Yokohama (JP); Yohichiroh Miyaguchi, Yokohama (JP); Nobuaki Kondoh, Yokohama (JP); Katsuo Sakai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 30 days.

(21) Appl. No.: 11/370,823

(22) Filed: Mar. 9, 2006

(65) Prior Publication Data

US 2006/0210320 A1 Sep. 21, 2006

(30) Foreign Application Priority Data

Mar. 9, 2005 (JP) ..... 2005-064703

(51) Int. Cl.
*G03G 15/08* (2006.01)

(52) U.S. Cl. ..... 399/265; 399/55

(58) Field of Classification Search ..... 399/265, 399/53, 55, 272
See application file for complete search history.

(56) References Cited

U.S. PATENT DOCUMENTS

| | | | |
|---|---|---|---|
| 4,281,051 | A | 7/1981 | Sakai |
| 4,335,194 | A | 6/1982 | Sakai |
| 4,384,033 | A | 5/1983 | Sakai |
| 4,407,917 | A | 10/1983 | Sakai |
| 4,521,502 | A | 6/1985 | Sakai et al. |
| 4,544,935 | A | 10/1985 | Sakai |
| 4,615,607 | A | 10/1986 | Yanagawa et al. |
| 4,655,579 | A | 4/1987 | Adachi et al. |
| 4,664,501 | A | 5/1987 | Koizumi et al. |
| 4,690,541 | A | 9/1987 | Sakai et al. |
| 4,933,727 | A | 6/1990 | Mizuma et al. |
| 5,121,170 | A | 6/1992 | Bannai et al. |
| 5,204,716 | A | 4/1993 | Kasahara et al. |
| 5,955,228 | A | 9/1999 | Sakai et al. |

(Continued)

FOREIGN PATENT DOCUMENTS

| | | |
|---|---|---|
| JP | 03-021967 | 1/1991 |

(Continued)

OTHER PUBLICATIONS

U.S. Appl. No. 11/734,389, filed Apr. 12, 2007, Aoki et al.

(Continued)

*Primary Examiner*—Quana Grainger
(74) *Attorney, Agent, or Firm*—Oblon, Spivak, McClelland, Maier & Neustadt, P.C.

(57) ABSTRACT

An image forming apparatus including an image carrier configured to have a latent image formed thereon, a developer carrier configured to supply toner, and a conveying member configured to receive toner from the developer carrier and to convey the toner to the image carrier. The conveying member includes first and second electrodes disposed a predetermined distance from one another. A first voltage application unit is configured to apply a first voltage to the developer carrier. A second voltage application unit is configured to apply a second voltage to the conveying member such that a ratio of a potential difference between the conveying member and the developer carrier to a distance between the conveying member and the developer carrier is less than a ratio of the second voltage to the predetermined distance.

20 Claims, 17 Drawing Sheets

U.S. PATENT DOCUMENTS

| | | | | |
|---|---|---|---|---|
| 6,512,909 | B2 * | 1/2003 | Ozawa et al. | 399/270 |
| 6,597,884 | B2 | 7/2003 | Miyaguchi et al. | |
| 6,597,887 | B2 | 7/2003 | Sakai et al. | |
| 6,708,014 | B2 | 3/2004 | Miyaguchi et al. | |
| 6,829,448 | B2 * | 12/2004 | Ozawa et al. | 399/55 |
| 6,901,231 | B1 | 5/2005 | Sakai et al. | |
| 6,941,098 | B2 | 9/2005 | Miyaguchi et al. | |
| 6,947,691 | B2 | 9/2005 | Miyaguchi et al. | |
| 2004/0105710 | A1 | 6/2004 | Shakuto et al. | |
| 2004/0126148 | A1 | 7/2004 | Iwai et al. | |
| 2004/0240907 | A1 | 12/2004 | Miyaguchi et al. | |
| 2004/0265024 | A1 | 12/2004 | Naruse et al. | |
| 2005/0002054 | A1 | 1/2005 | Shoji et al. | |
| 2005/0025525 | A1 | 2/2005 | Horike et al. | |
| 2005/0154562 | A1 | 7/2005 | Matsuura et al. | |
| 2005/0157327 | A1 | 7/2005 | Shoji et al. | |
| 2005/0158073 | A1 | 7/2005 | Nakazato et al. | |
| 2005/0169660 | A1 | 8/2005 | Yamada et al. | |
| 2006/0210320 | A1 | 9/2006 | Nakagawa et al. | |

FOREIGN PATENT DOCUMENTS

| | | |
|---|---|---|
| JP | 2000-047547 | 2/2000 |
| JP | 2002-078374 | 3/2002 |
| JP | 2002-264416 | 9/2002 |
| JP | 2004-198675 | 7/2004 |

OTHER PUBLICATIONS

U.S. Appl. No. 11/681,940, filed Mar. 5, 2007, Takahashi et al.
U.S. Appl. No. 11/546,251, filed Oct. 12, 2006, Tsukamoto et al.
U.S. Appl. No. 10/817,249, filed Apr. 5, 2004, Nakano et al.

* cited by examiner

TONER SUPPLYING SYSTEM FOR AN IMAGE FORMING APPARATUS

BACKGROUND OF THE INVENTION

1. Field of the Invention

The present invention relates to an image forming apparatus, and more particularly to an image forming apparatus stably and efficiently supplying toner.

2. Discussion of the Related Art

Known image forming apparatuses, such as printers, facsimiles, copiers, and multifunction apparatuses that print, fax and copy, generally use an electrophotographic process for image forming. The electrophotographic process includes a process of charging an image carrier, a latent image forming process, a developing process in which color powder (toner) is adhered, and a transferring process that transfers the toner image to a recording medium, such as paper.

The known image forming apparatus includes an image carrier, a toner transporting member and a power supply. The toner is supplied to the toner transporting member using a magnetic brush, for example, and is then conveyed to the image carrier. The toner transporting member includes a plurality of electrodes arranged on a base member. The power supply supplies a multiple-phase AC voltage to the electrodes.

The plurality of electrodes is configured to generate a traveling-wave electric field to move the toner, and the multiple-phase AC (n-phase) voltages are applied to the electrodes of the transporting member to form a traveling-wave electric field in a direction toward the image carrier, so that the positively charged toner moves towards the image carrier. The toner is adhered to the image carrier to develop a latent image on the image carrier.

By this configuration, the toner is conveyed by the traveling-wave electric field to the image carrier. The developing speed is limited, however, by the amount of toner supplied to the toner transporting member. If the toner is supplied using a magnetic brush roller, the amount of toner supplied by the magnetic brush roller determines the developing speed.

If the toner cannot be conveyed due to an unsuitable voltage condition applied to the electrodes, the toner may adhere to the toner transporting member. Moreover, the electric field generated on the toner transporting member also affects the toner supply to the toner transporting member. This is a problem unique to the image forming apparatus that uses the traveling-wave electric field. If the electric field on the toner transporting member prevents the toner from being supplied to the toner transporting member, the efficiency of the development degrades due to the lack of toner.

SUMMARY OF THE INVENTION

It is an object of the present invention to overcome one or more of the above-identified or other disadvantages.

The present invention can provide an image forming apparatus including an image carrier configured to form a latent image. A developing unit includes a developer carrier configured to carry toner, and a toner conveying member arranged between the image carrier and the developer carrier, including a plurality of electrodes arranged at predetermined intervals. The toner conveying member is configured to receive and convey the toner carried by the developer carrier to a region at which the toner conveying member faces the image carrier as a result of a conveying electric field generated by a plurality of electrodes with an application of multi-phased voltages. A first potential application mechanism is configured to apply a first voltage to the developer carrier. A second potential application mechanism is configured to apply a second voltage to the toner conveying member such that a first electric field defined as a ratio of a first potential difference between the toner conveying member and the developer carrier to a distance between the toner conveying member and the developer carrier is less than a second electric field defined as a ratio of the second voltage of the second potential application mechanism to a space between two adjacent electrodes of the plurality of electrodes.

The present invention further can provide an image forming apparatus including means for carrying an image. A developing unit includes means for carrying toner, and means for receiving and conveying the toner carried by the means for carrying toner to a region at which the means for conveying faces the means for carrying an image as a result of a conveying electric field generated by a plurality of electrodes at predetermined intervals with an application of the multiple-phased voltages and arranged between the means for carrying an image and the means for carrying toner. First means are used for applying a first voltage to the means for carrying toner. Second means are used for applying a second voltage to the means for conveying toner such that a first electric field defined as a ratio of a first potential difference between the means for conveying toner and the means for carrying toner to a distance between the means for conveying toner and the means for carrying toner is less than a second electric field defined as a ratio of the second voltage of the second potential apply means to a space between two adjacent electrodes of the plurality of electrodes.

The present invention further can provide an image forming apparatus including an image carrier configured to have a latent image formed thereon, a developer carrier configured to supply toner, and a conveying member configured to receive toner from the developer carrier and to convey the toner to the image carrier. The conveying member includes first and second electrodes disposed a predetermined distance from one another. A first voltage application unit is configured to apply a first voltage to the developer carrier. A second voltage application unit is configured to apply a second voltage to the conveying member such that a ratio of a potential difference between the conveying member and the developer carrier to a distance between the conveying member and the developer carrier is less than a ratio of the second voltage to the predetermined distance.

The present invention further can provide a method of conveying toner from a conveying member, which is configured to receive toner from a developer carrier, to an image carrier configured to have a latent image formed thereon. The method includes applying a first voltage the developer carrier, and applying a second voltage to first and second electrodes of the conveying member, which are disposed at predetermined distance from one another, such that a ratio of a potential difference between the conveying member and the developer carrier to a distance between the conveying member and the developer carrier is less than a ratio of the second voltage to the predetermined distance.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
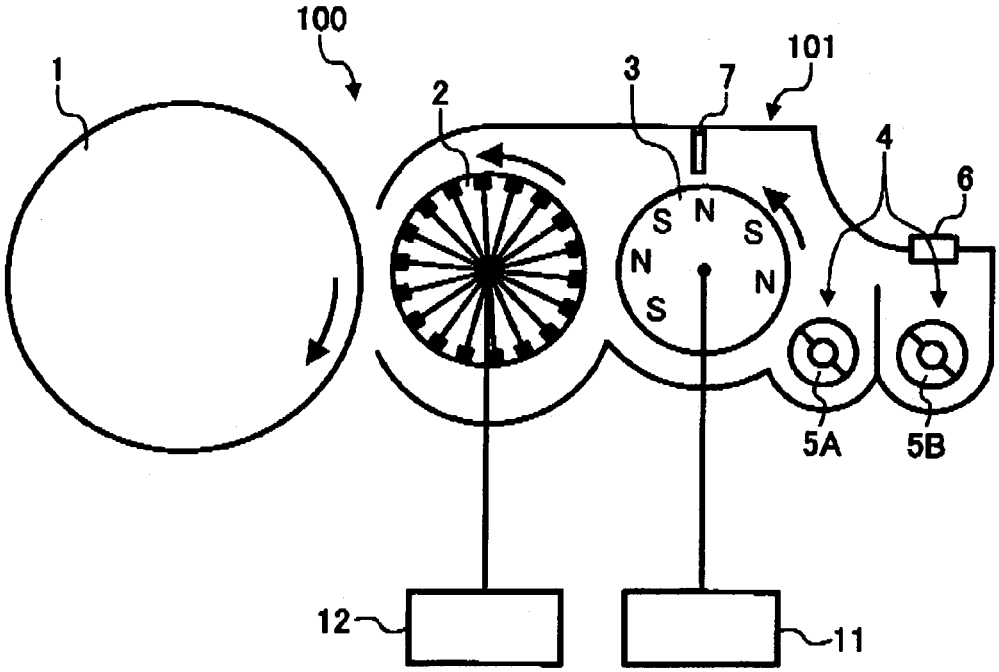
FIG. 1 is a schematic drawing showing a side view of portion of an image forming apparatus according to an embodiment of the present invention.

In describing preferred embodiments illustrated in the drawings, predetermined terminology is employed for clarity. However, the following description is not intended to be limited to the predetermined terminology selected, and it is to be understood that described components includes all technical equivalents that operate in a similar manner.

Referring now to the drawings, wherein like reference numerals designate identical or corresponding parts throughout the several views, FIG. 1 shows an image forming apparatus 100 according to an embodiment of the present invention.

As shown in FIG. 1, the image forming apparatus 100 includes an image carrier 1, a developing unit 101, and first- and second-potential application mechanisms 11 and 12, respectively. The developing unit 101 is a two-component developing system which utilizes a two-component developer including a magnetic carrier and a non-magnetic toner. The developing unit 101 includes a toner conveying member 2, a developer carrier 3 and a developer storage container 4.

The toner conveying member 2 is arranged in parallel with and in close vicinity to the image carrier 1 on which an electrostatic latent image is formed. The toner conveying ember 2 is configured to convey the toner to the developing area. The toner conveying member 2 preferably has a roller shape. The developer carrier 3 is arranged at an area facing the toner conveying member 2, and is configured to supply the toner to the toner conveying member 2. The developer storage container 4 contains the toner and magnetic carrier supplied to the developer carrier 3. Thus, the image carrier 1, the toner conveying member 2, and the developer carrier 3 are aligned in parallel in this order.

The toner conveying member 2 that faces the image carrier 1 is spaced apart from the image carrier 1, and faces the image carrier 1 with a gap therebetween from about 50 μm to about 1000 μm, preferably from about 150 μm to 400 μm. The toner conveying member 2 is not rotated but the toner is moved along a circumferential surface of the toner conveying member 2 in a direction, as indicated by an arrow in FIG. 1, by a conveying electric field (phase-shift electric field). The developer carrier 3 is rotated in a counterclockwise direction, as indicated by an arrow in FIG. 1.

The developer storage container 4 includes stirring-conveying screws 5A and 5B and is divided into two compartments, as illustrated in FIG. 1. Each compartment communicates with a developer path (not shown) arranged in the developing unit 101. The two-component developer is stored in the developer storage container 4 and is moved within the developer storage container 4 by being stirred by the stirring-conveying screws 5A and 5B.

The developer storage container 4 is provided with a toner supply opening 6 to receive the toner from a toner container (not shown). The developer storage container 4 is further provided with a toner density sensor (not shown) which detects a permeability of the developer, i.e., a density of the developer. If the density of the toner stored in the developer storage container 4 is detected as being below a predetermined amount, the toner is supplied through the toner supply opening 6 into the developer storage container 4.

The developer carrier 3 is arranged in an area facing the stirring-conveying screw 5A of the developer storage container 4. The developer carrier 3 includes a plurality of magnets which are fixed and alternately arranged inside the developer carrier 3, as illustrated in FIG. 1. By this arrangement, the developer in the developer storage container 4 is pumped up to the surface of the developer carrier 3 by a magnetic force when the developer carrier 3 is rotated.

The developing unit 101 further includes a regulating member 7 which is configured to regulate the amount of the developer carried on the surface of the developer carrier 3. As illustrated in FIG. 1, the regulating member 7 is arranged in close vicinity to the developer carrier 3 at a position downstream from the stirring-conveying screw 15A in a flow of the pumped-up developer along the per carrier 3 and upstream from the toner conveying member 2 in a flow of the developer conveyed from the developer carrier 3 to the toner conveying member 2. After regulation by the regulating member 7, the developer is conveyed to an area to face the toner conveying member 2.

A first voltage, which is a supply bias voltage, is applied by a first-potential application mechanism 11 to the developer carrier 3. A second voltage is applied by a second-potential a plication mechanism 12 to the toner conveying member 2.

The application of these voltages to the toner conveying member 2 and the developer carrier 3 generates an electric field between the toner conveying member 2 and the developer carrier 3. The toner conveyed in such an electric field receives an electrostatic force therefrom and is dissociated from the magnetic carrier. As a consequence, the toner dissociated from the magnetic carrier is moved to a surface of the toner conveying member 2. The toner that is received on the surface of the toner conveying member 2 is attracted to or "hops" on the surface of the toner conveying member 2 by the voltage applied by the second-potential application mechanism 12, and is conveyed towards the image carrier 1 as it hops.

After being received on the front of the image carrier 1, the toner moves to the image carrier 1 as a result of a developing electric field generated between an electrostatic latent image formed on the image carrier 1 and the toner conveying member 2. The electrostatic latent image on the image carrier 1 becomes a toner image. This process is referred to as development.

The developing unit 101 that utilizes the two-component developer including the magnetic carrier and the non-magnetic toner is generally capable of charging in a stable manner. This is because the toner is charged by contact friction with the magnetic carrier. Also, the developing unit 101 is capable of supplying a large amount of toner and is therefore suitable for high speed development. Thus, the developing unit 101 using the two-component developer can stably supply a relatively large amount of the charged toner to the toner conveying member 2.

Figure 2:
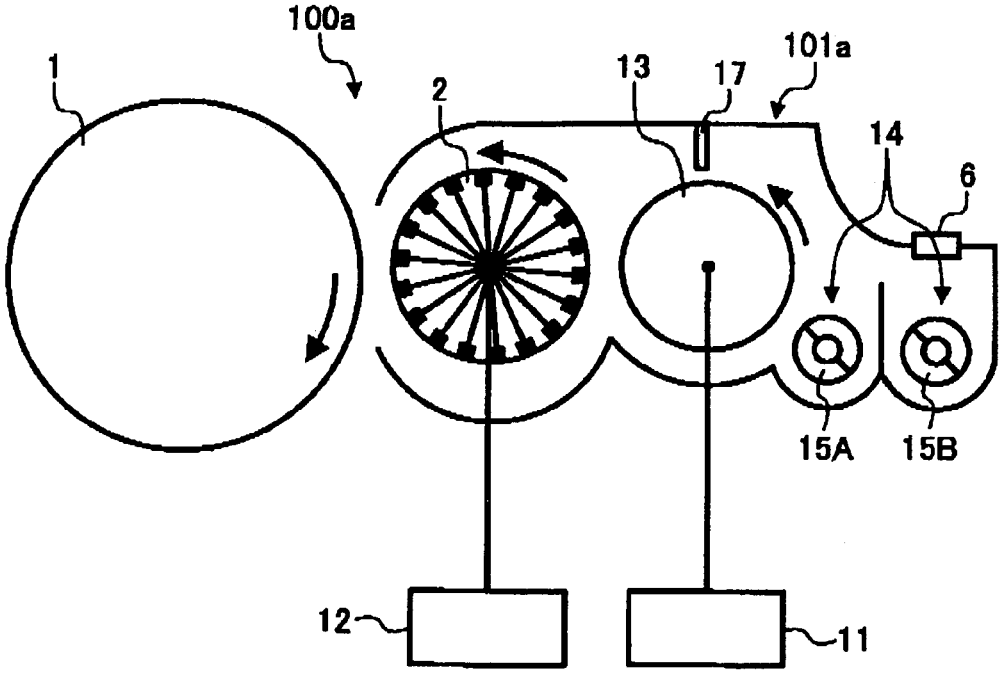
FIG. 2 is a schematic drawing showing a side view of a portion of an image forming apparatus according to another embodiment of the present invention.

Referring to FIG. 2, an image forming apparatus 100*a* according to another embodiment of the present invention is disclosed. Although the image forming apparatus 100*a* of FIG. 2 is similar to the image forming apparatus 100 of FIG. 1 except for a developing unit 101*a*, the image forming apparatus 100*a* includes a developing unit 101*a* that uses a mono-component developing system with non-magnetic toner. As illustrated in FIG. 2, the developing unit 100*a* includes a developer carrier 13, a developer storage container 14, toner supply rollers 15*a* and 15*b*, and a regulating member 17.

The image carrier 1 and the toner conveying member 2 are arranged in manners similar to those of the image forming apparatus 100 of FIG. 1. The toner conveying member 2 is arranged at a position to face the image carrier 1 in parallel and is configured to convey the toner to the area where the toner conveying member 2 faces the image carrier 1. The toner conveying member 2 preferably has a roller shape.

The developer carrier 13 is arranged in an area next to the toner conveying member 2, and is configured to supply the toner to the toner conveying member 2. In this embodiment, the developer carrier 13 can be non-magnetic. The developer storage container 14 contains toner that is supplied to the developer carrier 13. The image carrier 1, the toner conveying member 2, and the developer carrier 13 can be aligned in parallel as shown.

A gap between the toner conveying member 2 and the image carrier 1 can be from about 50 μm to about 1000 μm, preferably from about 150 μm to about 400 μm. The toner conveying member 2 itself is not rotated but the toner is moved along the circumferential surface of the toner conveying member 2 as a result of a conveying electric field (referred to as a phase-shift electric field), as indicated by an arrow in FIG. 2. The developer carrier 13 is rotated in a counterclockwise direction, as indicated by an arrow in FIG. 2.

The developer storage container 14 includes toner supply rollers 15A and 15B. The toner is pumped up to the developer carrier 13 by an electrostatic force caused by friction charging between the toner supply roller 15A and the developer carrier 13. Then the toner on the 13 is formed as thin film by a regulating member 17 and is conveyed to an area which faces the toner conveying member 2.

A first voltage is applied, as a supply bias voltage, by a first-potential application mechanism 11 to the developer carrier 13. A second voltage is applied by a second-potential application mechanism 12 to the toner conveying member 2.

At the area where the toner conveying member 2 is facing the developer carrier 13, an electric field is generated between the toner conveying member 2 and the developer carrier 13 by the first-potential application mechanism 11 and the second-potential application mechanism 12.

The toner is dissociated from the magnetic carrier by an electrostatic force of the electric field and is conveyed to a surface of the toner conveying member 2. The toner received on the surface of the toner conveying member 2 is attracted to or "hops" on the surface of the toner conveying member 2 and is conveyed (moved) by the voltage applied by the second-potential application mechanism 12.

When the toner arrives at the area which faces the image carrier 1, the toner moves to the image carrier 1 by a developing electric field between the image carrier 1 and the toner conveying member 2 to form the latent image on the image carrier 1.

When using the two-component developer, magnetic carrier can be separated from the toner as a result of collision impact with the toner conveying member, move to the toner conveying member and adhere to the surface of the toner conveying member at an area where toner is supplied. This problem is avoided when using the mono-component developer. The developer storage container therefore has a simple configuration, and a compact and less expensive developing unit can be obtained.

Figure 3:
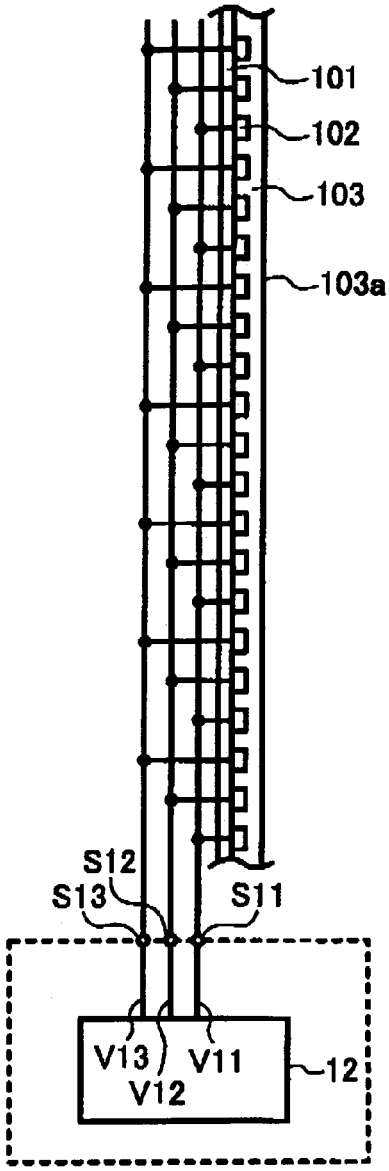
FIG. 3 is a drawing illustrating a toner conveying member of the image forming apparatus of FIG. 1.

FIG. 3 illustrates electrical connections between the toner conveying member 2 and the second-potential application mechanism 12. In FIG. 3, a portion of a surface of the toner conveying member 2 is illustrated in cross section in a direction perpendicular to a lengthwise direction of the toner conveying member 2, such that the toner conveying member 2 is adjacent to the developer carrier 3 on the right side and to the image carrier 1 on the left side. As illustrated in FIG. 3, the toner conveying member 2 includes a support substrate 101, a plurality of electrodes 102, and a surface protecting layer 103. The plurality of electrodes 102 and the surface protecting layer 103 are formed on the support substrate 101. The plurality of electrodes 102 is mounted at regular intervals in a direction in which the toner is moved as a result of the plurality of electrodes, the electrodes grouped in plural sets of n-number of electrodes, in which n is a positive integer and represents a number of phases of electric power used. The surface protecting layer 103 is made of an organic or an inorganic insulating material and is laminated on the support substrate 101 and the electrodes 102 to protect the electrodes 102. The surface protecting layer 103 forms an electrostatic conveying surface 103*a*.

The supporting substrate 101 may be made of any one of other insulating materials such as glass, resin and ceramic, conductive material coated with an insulating film such as stainless steel (SUS) coated with a $SiO_2$ film and flexible transformable material such as a polyimide film.

To form the electrodes 102, a conductive material such as AL, Ni—Cr and so on is primarily coated on the supporting substrate 101, with a thickness from approximately 0.1 μm to approximately 10 μm, and preferably from approximately 0.5 μm to approximately 2.0 μm. Then, the conductive material coated on the supporting substrate 101 is transformed into a predetermined pattern (i.e., the pattern of the electrodes 102) using a photolithographic technique, for example.

The electrode 102 has a width L in a conveying direction of the developer powder. This width L is defined as a value between a value greater than an average diameter of the developer powder and a value less than twenty times the average diameter of the developer powder. Moreover, the electrodes 102 are spaced with a space R in a conveying direction of developer powder. This space R is also defined as a value between a value greater than an average diameter of the developer powder and a value less than twenty times of the average diameter of the developer powder. The surface protecting layer 103 is formed with a thickness from approximately 0.5 μm to approximately 10 μm, and preferably from approximately 0.5 μm to approximately 3.0 μm using a material such as $SiO_2$, $TiO_2$, $TiO_4$, SiON, BN, TiN or $Ta_2O_5$, for example.

In FIG. 3, a line from each electrode 102 represents a conductive line applying voltage to each electrode 102. Each black dot represents an electrical connection between a vertical line and a horizontal line. Other portions of the line are electrically insulated. The second-potential application mechanism 12 applies three voltages V11 to V13, having different phases, to the electrodes 102. Although this embodiment uses three phase driving voltages (i.e., n=3), the present invention described above is applicable to other cases in which any given natural number greater than two (n>2) voltages is used.

The developing unit 101 includes terminals S11, S12, and S13 to which each one of the plurality of electrodes is connected. Each one of the terminals S11, S12 and S13 is connected to the second-potential application mechanism 12 which supplies voltages V11, V12, and V13 respectively.

Next, a principle of the electrostatic conveying mechanism applied to the toner conveying member 2 is now described. When the second-potential application mechanism 12 applies n-phase voltages to the plurality of electrodes 102, the plurality of electrodes 102 generates a phase-shift electric field (referred to as a conveying electric field, or a traveling electric field). The phase-shift electric field charges the toner particles to move them in a conveying direction as a result of a repulsive force and an attractive force.

Figure 4:
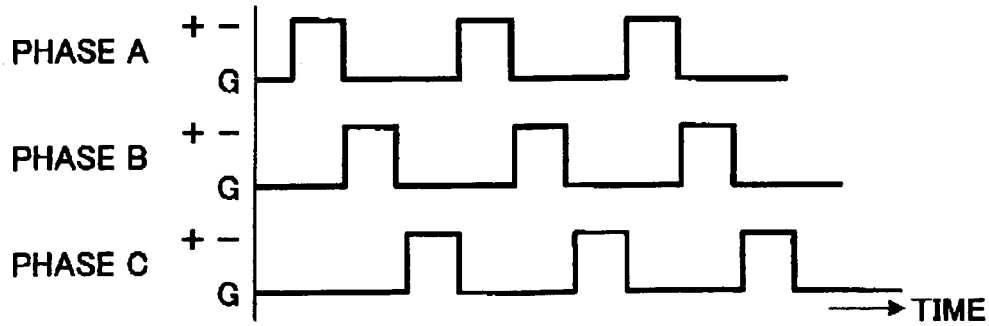
FIG. 4 is a time chart of driving voltages associated with the toner conveying member of FIG. 3.
Figure 5A:
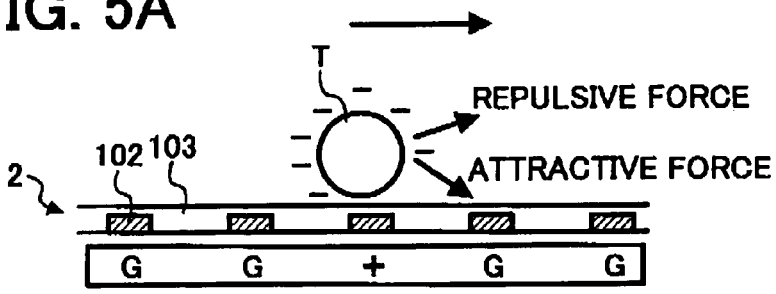
FIGS. 5A, 5B and 5C are schematic drawings illustrating a principle of toner conveyance conducted by the toner conveying member of FIG. 3.
Figure 5B:
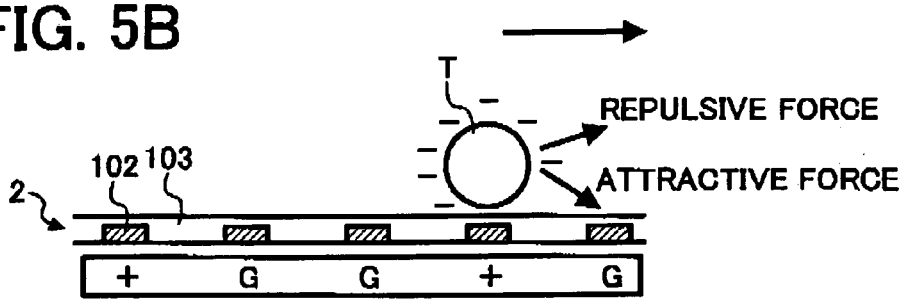
Figure 5C:
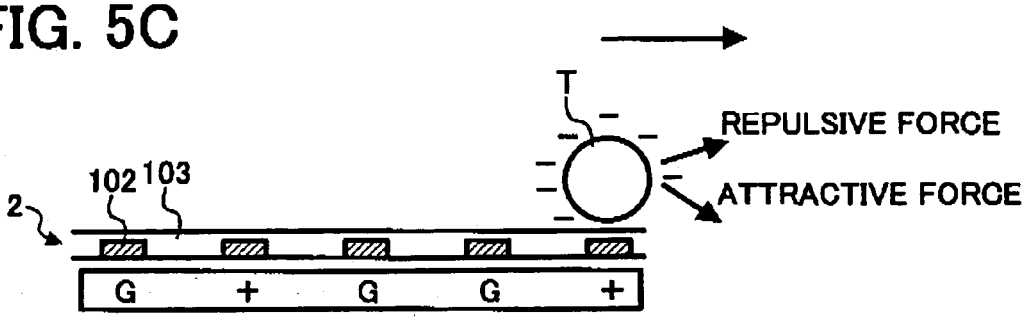

More specifically, as illustrated in FIG. 4, three phase pulse waves, A-phase, B-phase and C-phase, are sequentially applied to; each of the plural sets of n-number of the electrodes 102 of the toner conveying member 2. In addition, the sequential application of these three phase pulse waves to the different sets of electrodes 102 is not made at the same time but is shifted. Each of the three phase pulse waves has an amplitude between ground level (0V) and a predetermined positive voltage (+). FIGS. 5A-5C illustrate how a negatively-charged toner, for example, is moved on the toner conveying member 2 in the toner conveying direction when the three phase-voltages sequentially applied with time shift to the plural sets of electrodes 102 vary between the ground level (G) and the predetermined positive level (+).

FIG. 5A illustrates a time at which the voltages applied to the electrodes 102 next to each other are G, G, +, G, and G, for example. The toner having the negative charge is attracted to the electrode 102 having the positive voltage (+) as a result of attractive force associated with the positive voltage. Then, as illustrated in FIG. 5B, the voltages are shifted to +, G, G, +, and G. This shift causes the toner to move away as a result of repulsive force from the approaching voltage G and an attractive force from the positive voltage at the next position in the toner conveying direction. This movement of the negatively-charge toner, as a result of repulsive force and attractive force, is repeated as the three voltages are sequentially shifted. As a result, the toner is conveyed in the toner conveying direction In a case where a positively charged toner is applied, an application of the predetermined positive voltage (+) is changed to a predetermined negative voltage (−). That is, the voltages applied to the electrodes aligned next to each other may appear as G, G, −, and G, for example, in which the predetermined negative voltage (−) is shown instead of the predetermined positive voltage (+). By shifting the negative voltage (−), the positively charged toner can be conveyed in the toner conveying direction.

Figure 6:
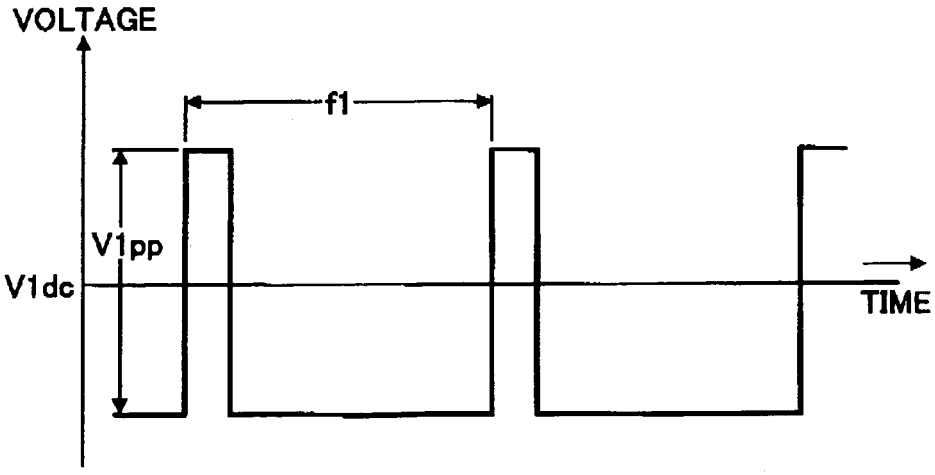
FIG. 6 is a time chart of voltages applied by a first potential application mechanism.
Figure 7:
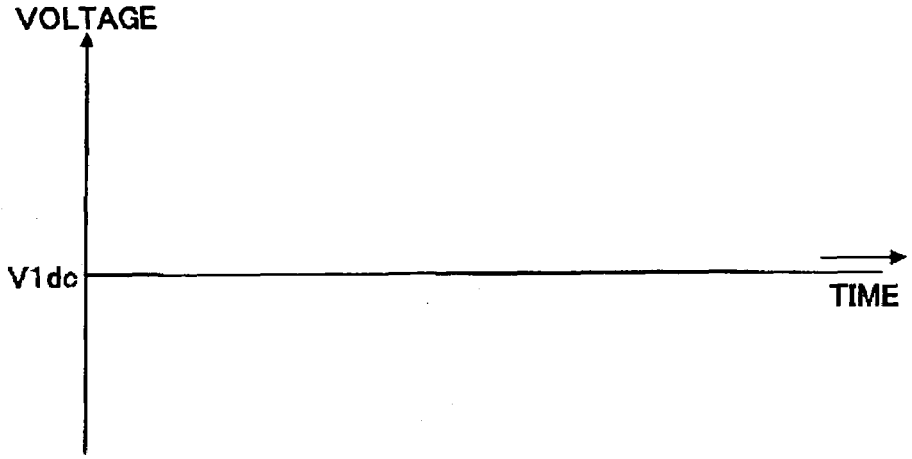
FIG. 7 is a time chart of different voltages applied by the first potential application mechanism.
Figure 8:
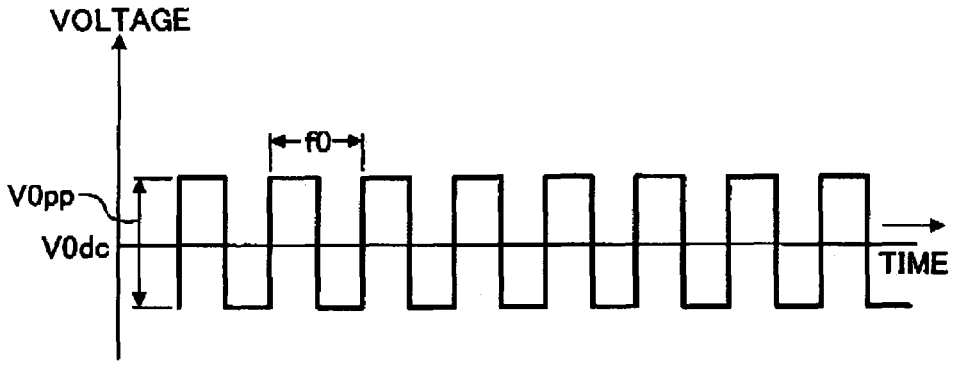
FIG. 8 is a time chart of voltages applied by a second potential application mechanism.

Referring to FIGS. 6-8, a procedure for applying voltages with the first-potential application mechanism 11 and the second-potential application mechanism 12 is now described. In the developing unit 101, for example, the toner is negatively charged as a result of friction between toner and magnetic particles or between toner and the developer carrier 3.

As described above, the developer is conveyed to a region where the developer faces the toner conveying member 2, by the developer carrier 3. The toner is caused to separate from the magnetic carrier by the bias voltage applied by the first-potential application mechanism 11 and is moved to the toner conveying member 2.

In this case, the voltage applied to the developer carrier 3 by the first-potential application mechanism 11 is determined such that a first electric field defined as a potential difference between the toner conveying member 2 and the developer carrier 3 divided by a distance between the toner conveying member 2 and the developer carrier 3, is less than a second electric field defined as a voltage of the electrode 102 of the toner conveying member 2 applied by the second-potential application mechanism 12 divided by a space between the electrodes 102.

Other examples of the voltage (V1) applied to the developer carrier 3 by the first-potential application mechanism 11 are shown in FIGS. 6 and 7. Also, another example of the voltage (V0) applied to the electrode 102 of the toner conveying member 2 by the second-potential application mechanism 12 is shown in FIG. 8.

In FIG. 8, the voltage V0 is generated with a DC (direct current) voltage V0*dc* superimposed by an AC (alternating current) voltage which has a rectangular wave V0*pp* changing at a frequency f0. The voltage V1 is generated with a DC voltage V1*dc* superimposed by an AC voltage which has a rectangular wave V1*pp* changing at a frequency f1 in FIG. 6. Further, FIG. 7 illustrates a case where the voltage V1 has a DC voltage component V1*dc* only.

Figure 9:
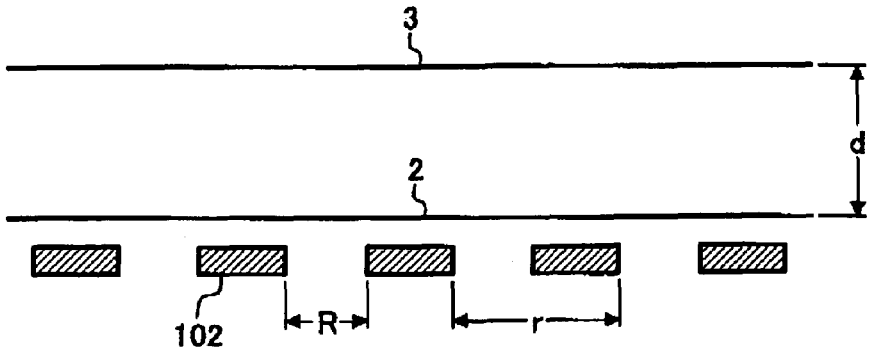
FIG. 9 is a schematic drawing illustrating a configuration of a developer carrier and electrodes at the toner conveying member.

FIG. 9 illustrates a schematic representing the electrodes 102 of the conveying member 2. In the drawings, d is a distance between the conveying member 2 and the developer carrier 3, R is a distance between electrodes 102 of the conveying member 2 adjacent to each other, r is a pitch of the electrodes, V1 is a voltage applied to the developer carrier 3 and V0 and V0' are voltages applied to the electrodes located adjacent to each other.

The electrical field E2 which is appearing on the toner conveying member 2 is defined as:

$$E2=|(V0-V0')/R|.$$

As shown in FIG. 8, a voltage that is applied to the electrodes 102 of the toner conveying member 2 is an overlapping voltage of a DC voltage and an AC voltage. Therefore, the maximum value of electric field E2 is |V0*pp*/R|.

A potential difference between the toner conveying member 2 and the developer carrier 3 is |V0−V1|. The voltage applied to the electrodes 102 of the toner conveying member 2 is an overlapping voltage of a DC voltage and an AC voltage changing with a frequency f0 as shown in FIG. 8. As the frequency of the voltage wave is large, the voltage applied to the electrodes 102 of the toner conveying member 2 is considered to be equal to an average DC voltage V0*dc*. When the voltage applied to the developer carrier 3 is a DC voltage, a potential difference between the toner conveying member 2 and the developer carrier 3 is |V0*dc*−V1*dc*|.

Therefore, the supply electric field between the toner conveying member 2 and the developer carrier 3 is defined as:

$$E1=|(V0dc-V1dc)/d|.$$

In this exemplary embodiment, the voltage applied to the developer carrier 3 satisfies the following relationship, $$E2=|(V0pp)/R|>E1=|(V0dc-V1dc)/d|.$$

Specifically, the supply electric field E1 is less than the conveying electric field E2.

When the voltage applied to the developer carrier 3 is an overlapping voltage of a DC voltage and an AC voltage as shown in FIG. 6, the potential difference between the toner conveying member 2 and the developer carrier 3 varies as a function of time. As a result, the electric field between the toner conveying member 2 and the developer carrier 3 also varies as a function of time. As far as the electric field between the toner conveying member 2 and the developer carrier 3 is concerned, it is useful to compare a maximum value of the electric field that is a maximum voltage difference of AC component.

In this case, the potential difference between the toner conveying member 2 and the developer carrier 3 is defined as:

$$(|(V0dc-V1dc)|+V1pp/2).$$

Then, the electric field E1 is expressed by a formula, $$E1=(|(V0dc-V1dc)|+V1pp/2)/d.$$

In this exemplary embodiment, the voltage is to be applied to the developer carrier 3 by the first-potential application mechanism 11 so that the voltages satisfy the following relationship, $$|(V0pp)/R|>(|(V0dc-V1dc)|+V1pp/2)/d.$$

Thus, the electric field expressed by the potential difference between the toner conveying member 2 and the developer carrier 3 divided by the distance, is less than the electric field expressed by the voltage difference between the electrodes applied by the second-potential application mechanism 12 divided by the distance between electrodes.

Conversely, when the electric field shown by a potential difference between the toner conveying member 2 and the developer carrier 3 divided by the distance, is larger than the electric field shown by the voltage difference between the electrodes applied by the second-potential application mechanism 12 divide by the distance between the electrodes, the conveying electric field is affected by the electric field between the toner conveying member 2 and the developer carrier 3.

Then, the toner which is moved to the toner conveying member 2 from the developer carrier 3 remains on a surface of the toner conveying member 2. Thus, the toner is not conveyed by the conveying electric field and is not supplied sufficiently to the image carrier. Consequently, the toner supply efficiency is decreased.

According to the exemplary embodiment, the electric field expressed by a potential difference between the toner conveying member 2 and the developer carrier 3 divided by the distance, is determined to be less than the electric field expressed by a voltage difference between the electrodes applied by the second-potential application mechanism 12 divided by the distance between electrodes so that the conveying electric field affects the toner efficiently and the toner moves to the toner conveying member 2 sufficiently.

The toner is attracted to the surface of the toner conveying member 2 and is conveyed by the conveying electric field so as to develop the latent image on the image carrier. It is also possible to prevent adherence of the toner at the toner supply portion and to avoid supplying an insufficient amount of toner.

As described, when the voltage applied by the first-potential application mechanism 11 is an overlapping voltage of a DC voltage and an AC voltage, the potential difference between the toner conveying member 2 and the developer carrier 3 varies as a function of time. As a result, the electric field between the toner conveying member 2 and the developer carrier 3 also varies as a function of time. A voltage is to be applied by the first-potential application mechanism 11 such that a maximum value of the electric field among the electric fields, which varies as a function of time, is less than an electric field, which is expressed by a relation of a voltage difference between the electrodes applied by the second-potential application mechanism 12 divided by a distance between the electrodes of the toner conveying member.

In this case, it is possible to provide a stable condition in which the electric field that is expressed by a relation of a potential difference between the toner conveying member 2 and the developer carrier 3 divided by the distance, is less than the electric field that is expressed by a relation of a voltage difference between the electrodes applied by the second-potential application mechanism 12 divided by the distance between the electrodes 102.

More specifically in this exemplary embodiment, the distance R between the electrodes 102 of the toner conveying member 2 is 30 μm. The distance between the toner conveying member 2 and the developer carrier 3 is ~1 mm. The voltage V0 which is applied by the second-potential application mechanism 12 is formed by voltages V0*dc*=0 v (DC) and V0*pp*=from 60 v to 300 v (AC). The voltage V1 which is applied by the first-potential application mechanism 11 is comprised with voltages (V1*dc* (DC) and V1*pp* (AC))=(250 v, 500 v), (500 v, 1000 v) and (800 v, 1600 v).

The electric field E2, which is expressed with a relation of a voltage difference V0 between the electrodes 102 applied by the second-potential application mechanism 12 divided by the distance between the electrodes, becomes its smallest value when V0*pp*=60 v. And the electric field is $|(V0pp)/R|=2*10^6$ V/m. The electric field, which is expressed by a relation of a potential difference between the toner conveying member 2 and the developer carrier 3 divided by the distance, becomes its maximum value when (V1*dc* (DC) and V1*pp* (AC))=(800 v, 1600 v). And the electric field is $(|(V0dc-V1dc)|+V1pp/2)/d=1.6*10^6$V/m. Therefore, this condition satisfies the relationship, $|(V0pp)/R|>(|(V0dc-V1dc)|+V1pp/2)/d$.

Figure 10:
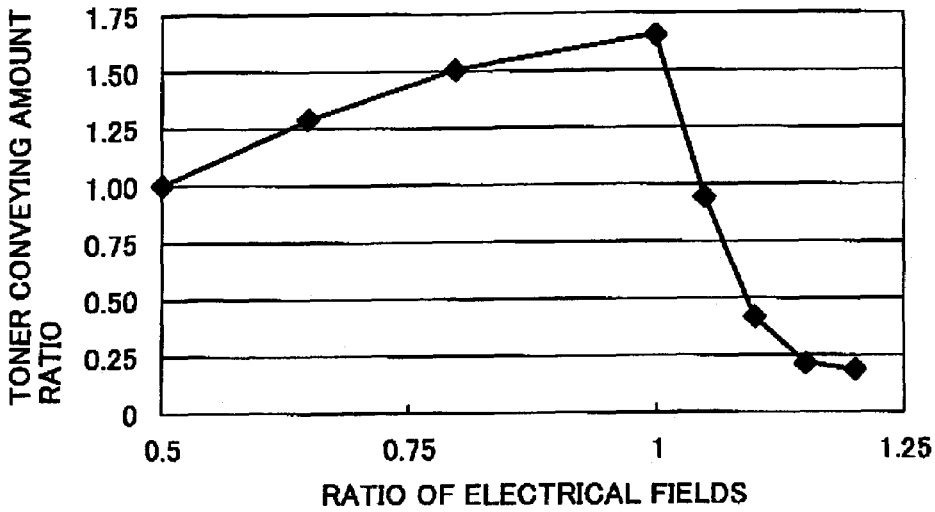
FIG. 10 is a graph representing a measurement result of the amount of toner conveyed.

FIG. 10 is a measurement result of the amount of toner conveyed when the combination of DC and AC voltages V1 (V1*dc*, V1*pp*) is changed with the distance between electrodes R is 30 μm, the distance between the toner conveying member 2 and the developer carrier 3 is 1 mm, the voltage applied by the second-potential application mechanism 12 V0*dc* is 0 v and V0*pp* is 60 v.

A horizontal axis of the FIG. 10 is a ratio of $(|(V0dc-V1dc)|+V1pp/2)/d$ and $|(V0pp)/R|$ and a vertical axis is a toner convey ratio at the condition of (V1*dc* (DC) and V1*pp* (AC))=(500 v, 1000 v).

According to FIG. 10, when the ratio of the electric fields is below "1" and (V1*dc* (DC) and V1*pp* (AC)) are larger values, the amount of toner conveyed increases. This is because the amount of toner supplied increases by increasing the electric field between the toner conveying member 2 and the developer carrier 3.

Within the range, the electric fields satisfy the following relationship, $|(V0pp)/R|>(|(V0dc-V1dc)|+V1pp/2)/d$. The toner supplied the toner conveying member 2 is efficiently conveyed by the conveying electric field.

Conversely, when the ratio of the electric fields is larger than "1", the amount of toner conveyed decreases dramatically. This is because the electric fields do not satisfy the relationship, $|(V0pp)/R|>(|(V0dc-V1dc)|+V1pp/2)/d$. Further, the conveying electric field is affected by the electric field between the toner conveying member 2 and the developer carrier 3. Then the toner supplied stays on and adheres to a surface of the toner conveying member 2.

Further, when the ratio increases, the toner is less affected by the conveying electric field. As a result, the amount of toner adhering onto the surface of the toner conveying member 2 increases.

A condition of the voltages, in which the toner is conveyed without adhering on the surface of the toner conveying member 2 and with the effective conveying electric field, satisfies the following relationship, $|(V0pp)/R|>|(V0dc-V1dc)|/d$, when DC voltages are only applied and $|(V0pp)/R|>(|(V0dc-V1dc)|+V1pp/2)/d$, when DC voltages are superimposed by AC voltages.

An average value of the voltage V0 (average voltage V0) applied by the second-potential application mechanism 12 and an average value of the voltage V1 (average voltage V1) applied by the first-potential application mechanism 11 is now described. The average voltage V1 applied by the first-potential application mechanism 11, is set to be less than the average voltage applied by the second-potential application mechanism 12 when the toner is negatively charged, and is set to be greater when the toner is positively charged.

Figure 11:
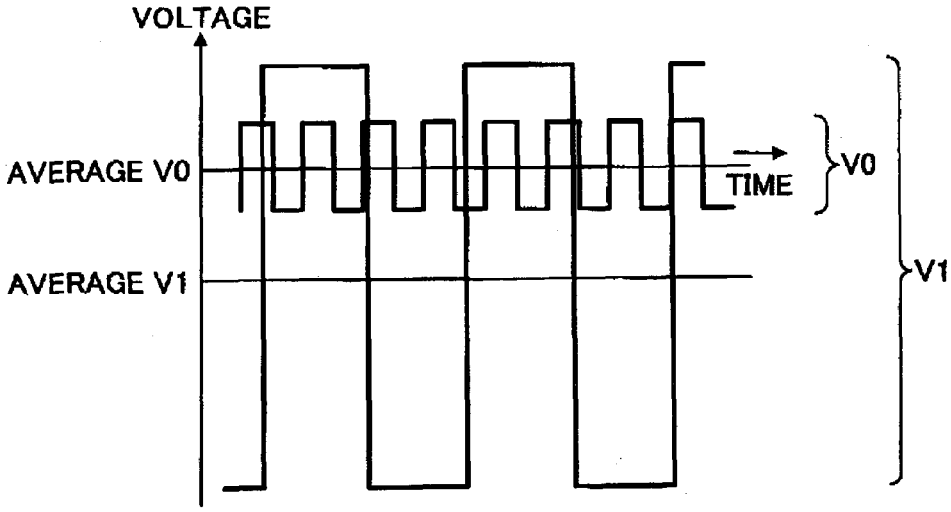
FIG. 11 is a time chart of voltages applied by the first potential application mechanism and a voltage applied by the second potential application mechanism.

FIG. 11 illustrates an example of the voltages which are one phase voltages V0 applied to the toner conveying member 2 by the second-potential application mechanism 12 and a voltage V1 applied by the first-potential application mechanism 11 when the toner is negatively charged.

The voltages, Vo and V1, are DC voltages V0*dc* and V1*dc* superimposed by AC voltages respectively. As shown in FIG. 11, the duty of the AC components both for V0 and V1 are 50%. Generally, if a DC voltage is superimposed by an AC wave, the voltage varies as a function of time. However, the duty of the voltages, V0 and V1, are both 50% so that the average voltages are equal to the voltages V0*dc* and V1*dc*.

In this example, the average voltage V1*dc* is less than the average voltage V0*dc*. The electric field between the toner conveying member 2 and the developer carrier 3 varies as a function of time, however, the electric field from the toner conveying member 2 to the developer carrier 3 dominates from the point of view of time integration. As a result, the toner on the developer carrier 3 is moved to the toner conveying member 2 by the electric field between the toner conveying member 2 and the developer carrier 3 when the toner is negatively charged.

Figure 12:
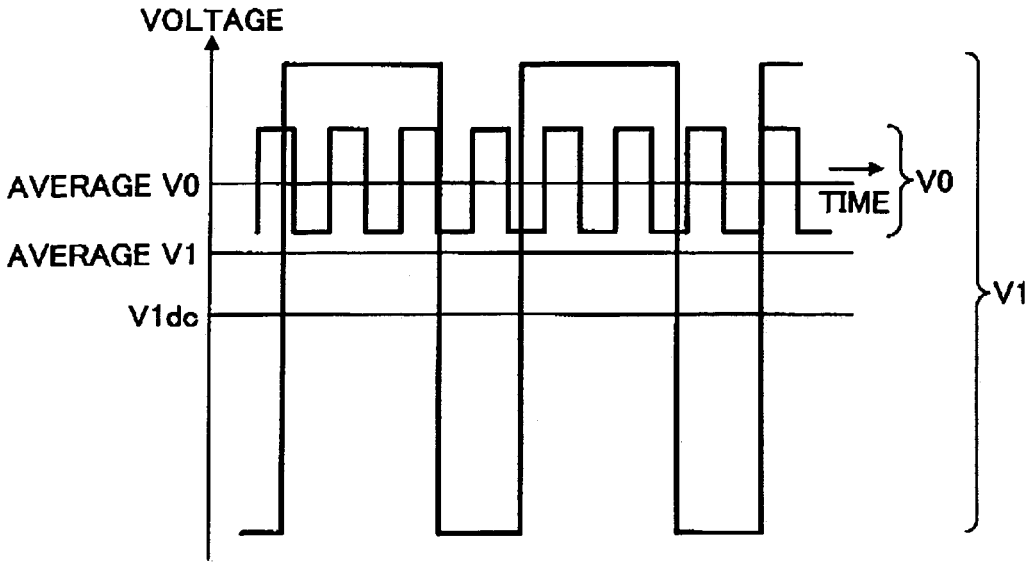
FIG. 12 is a time chart of different voltages applied by the first potential application mechanism and a voltage applied by the second potential application mechanism.

FIG. 12 illustrates another example using voltages, V0 and V1. In this example, the voltage V0 is same as the voltage V0 in FIG. 11. Regarding the voltage V1, the DC voltage and the amplitude of AC are the same as the voltage V1 in FIG. 11. However, a duty of the voltage V1 differs from the case of the FIG. 11 that is more than 50% and the period of High level of the AC component is longer than the Low level of the AC component.

In this case, the average voltage V1 is not the same as V1*dc* in FIG. 11. The average voltage V1 increases because the duty is larger and the period of High level is longer. With the duty shown in FIG. 12, the average voltage V1 is less than the average voltage V0 (=V0*dc*). Therefore, the electric field from the toner conveying member 2 to the developer carrier 3 dominates when the electric fields are integrated. As a result, the toner on the developer carrier 3 is moved to the toner conveying member 2 by the electric field.

Figure 13:
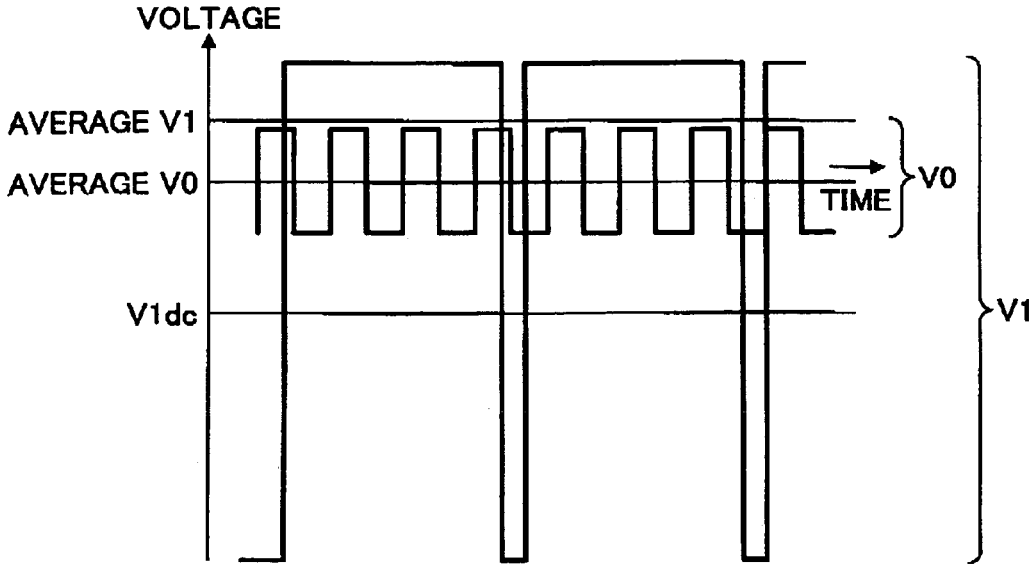
FIG. 13 illustrates another example of voltages applied by the first potential application mechanism and a voltage applied by the second potential application mechanism.

FIG. 13 illustrates another example using a voltage V1 having a larger duty. In this example, a voltage V0 is also same as the voltage V0 in FIG. 11. Regarding the voltage V1, a duty of the voltage V1 is much greater than in FIG. 11 and the period of High level of the AC component is much longer than the Low level of the AC component. Therefore, the average voltage V1 is larger than the average voltage V0 (=V0*dc*).

When such a voltage V0 is applied, the electric field from the developer carrier 3 to the toner conveying member 2 dominates when the electric fields are integrated. As a result, the toner receives an electrostatic force which directs from the toner conveying member 2 to the developer carrier 3, and is not possible to move the toner to the toner conveying member 2. Accordingly, the average voltage applied by the first-potential application mechanism 11 is set to be less than the average voltage applied by the second-potential application mechanism 12 when the toner is negatively charged and is set to be greater than the average voltage applied by the second-potential application mechanism 12 when the toner is positively charged.

Figure 14:
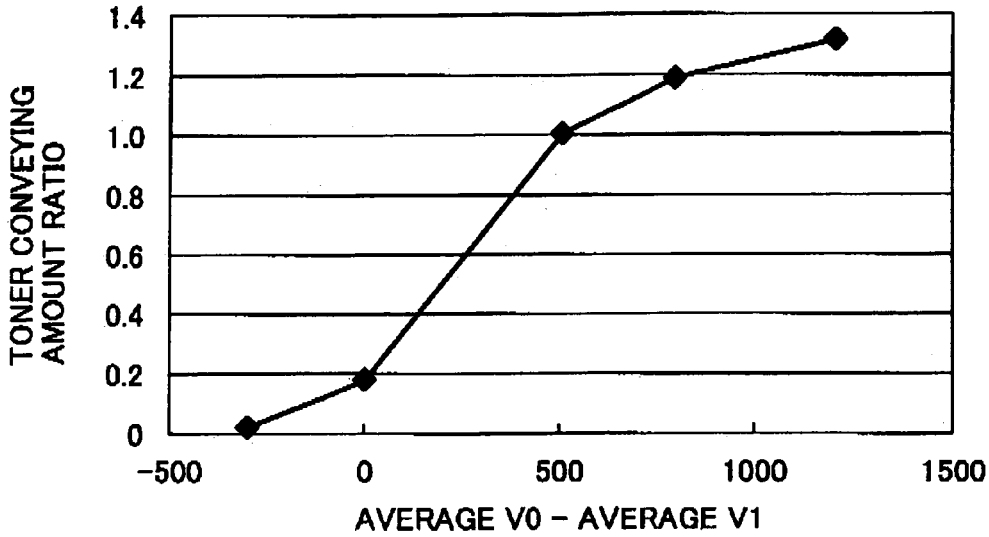
FIG. 14 is a graph illustrating the relationship between a conveying toner amount ratio and a difference of average voltages.

FIG. 14 is a drawing showing a relationship between a toner conveying amount ratio and an average voltage differences (V0−V1). The average voltage (V0−V1) is plotted by changing the duty of voltage V1 with the condition of V0*dc*=0 v, V1*dc*=−500 v and V1*pp*=2000 v. The toner conveying amount ratio is a ratio of the toner conveying amount at the average voltage difference (V0−V1) to a toner conveying amount when the average voltage (V0−V1) is 500 v and the duty is 50%.

As shown in FIG. 14, a relatively small amount of toner is moved when the average voltage (V0−V1) is negative. The negatively charged toner receives an electrostatic force in a reverse direction of the electric field for the movement to the toner conveying member 2, and the toner is not moved to the toner conveying member 2 because of the existence of the electric field from the developer carrier 3 to the toner conveying member 2.

When the average voltage (V0−V1) is positive, the negatively charged toner receives an electrostatic force from the developer carrier 3 to the toner conveying member 2, and is possible to move to the toner conveying member 2 so as to increase the toner amount moving to the toner conveying member 2.

Since the average voltage applied by the first-potential application mechanism 11 is set to be less than the voltage applied by the second-potential application mechanism 12 when the toner is negatively charged and is set to be greater when the toner is positively charged as described, it is possible to move the toner to the toner conveying member 2 by the electrostatic force between the developer carrier 3 and the toner conveying member 2. Consequently, the toner is moved sufficiently and constantly.

A relation between a conveying speed of a developer at the developer carrier 3 and a conveying speed of a toner at the toner conveying member 2 is now described. In this exemplary embodiment, the conveying speed v1 of the developer on the developer carrier 3 is set to be less than the conveying speed v2 on the toner on the surface of the toner conveying member 2.

The toner conveying speed v2 on the surface of the toner conveying member 2 is expressed as follows, $$v2=r\times n\times f$$

where r is a pitch between the electrodes of the toner conveying member 2, n is a number of phases of the voltages applied to the electrodes 102 and f is a frequency of AC voltage.

Figure 15:
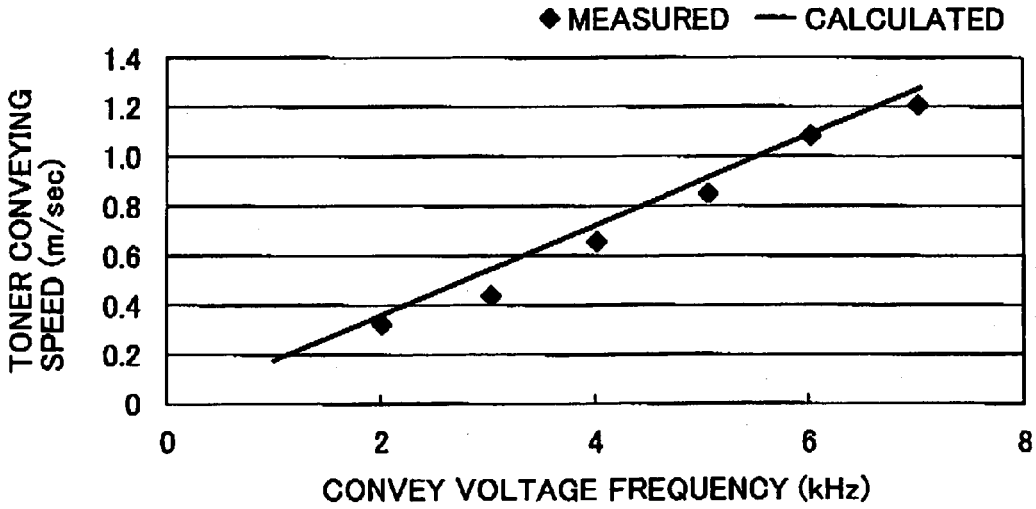
FIG. 15 is a graph illustrating an actual measurement value of a toner conveying speed versus a calculated value.

FIG. 15 is a graph illustrating an actual measurement value of the toner conveying speed versus a calculated value. As shown in FIG. 15, the measurement value of the toner conveying speed corresponds well to the calculated value.

When the conveying speed of a developer on the developer carrier 3 v1 is larger than the toner conveying speed v2 on the surface of the toner conveying member 2, the amount of toner supplied from the developer carrier 3 is greater than the amount of toner conveyed by the toner conveying member 2 at the area where the toner conveying member 2 faces the developer carrier 3. As a result, the toner is supplied but the toner which stays at the area gradually increases.

To overcome the problem, the conveying speed of a developer on the developer carrier 3 v1 is set to be less than the toner conveying speed v2 on the surface of the toner conveying member 2, so that the toner is constantly conveyed by the electric field without remaining on the surface of the toner conveying member 2.

Figure 16:
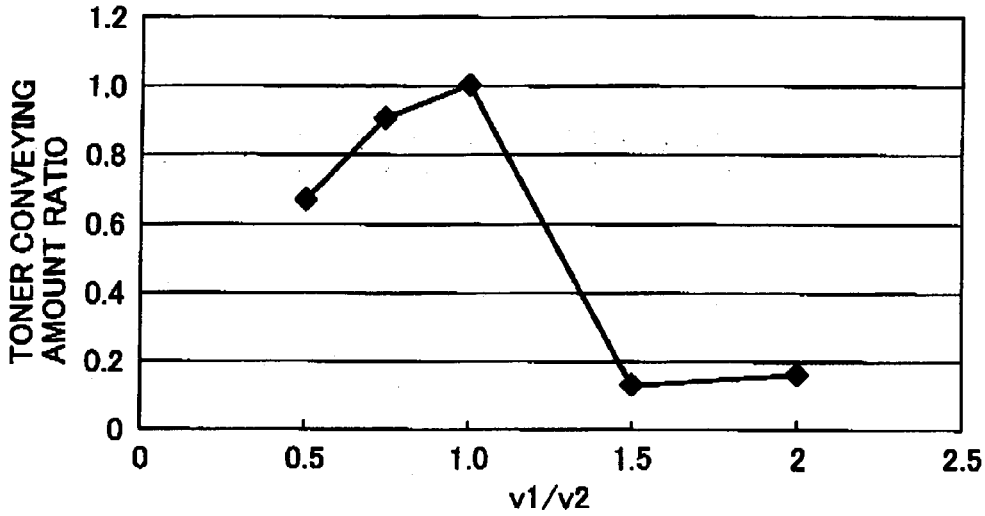
FIG. 16 is a graph illustrating a toner conveying amount ratio versus a ratio of the speed of a developer conveying on the developer carrier to the toner conveying speed.

FIG. 16 is a graph illustrating a toner conveying amount ratio versus a ratio of the conveying speed v1 of a developer on the developer carrier 3 to the toner conveying speed v2 on the surface of the toner conveying member 2. The toner conveying amount ratio is a ratio of a toner conveying amount at a given speed to a toner conveying amount when a ratio of the speeds is "1".

When the ratio of the speeds less than "1" referring to FIG. 16, the toner amount conveyed increases when the conveying speed of the developer on the developer carrier v1 increases. The amount of the developer passing through a supplying portion in which the toner conveying member 2 faces the developer carrier 3 increases depending on the increase of the conveying speed of the developer on the developer carrier 3 v1. Instead of the increase of amount of toner conveyed to the toner conveying member 2, all the toner supplied may be conveyed because the toner conveying speed v2 on the surface of the toner conveying member 2 is much greater than the speed of a developer conveying on the developer carrier 3 v1. Consequently, there is an increase in the amount of toner conveyed.

Conversely, when the ratio of the speeds is larger than "1", the amount of the developer passing through the supplying portion in which the toner conveying member 2 faces the developer carrier 3 increases more and the amount of toner conveyed increases. However, the toner supplied may remain on the supplying portion because the toner conveying speed v2 on the surface of the toner conveying member 2 is much less than the speed of a developer conveying on the developer carrier 3 v1. Consequently, there is a decrease in the amount of toner conveyed.

Once the toner is adhered and accumulated at the supplying portion between the toner conveying member 2 and the developer carrier 3, following toner to be supplied is blocked by the accumulated toner. This creates a vicious cycle where the subsequent toner is not conveyed. Consequently, the amount of toner conveyed decreases rapidly.

Thus, if the toner conveying speed v2 on the surface of the toner conveying member 2 is set to be greater than the conveying speed of a developer on the developer carrier 3 v1, adherence of the toner to the toner conveying member 2 at the area between the toner conveying member 2 and the developer carrier 3 can be avoided.

The voltage applied to the developer carrier 3 by the first-potential application mechanism 11 is now described. In this exemplary embodiment, the first-potential application mechanism 11 applies an overlapping voltage of a DC voltage and an AC voltage to the developer carrier 3.

Since the voltage used is the overlapping voltage of a DC voltage and an AC voltage, the potential difference between the toner conveying member 2 and the developer carrier 3 varies as a function of time. As a result, the toner vibrates and is easily released from the magnetic carrier because the electric field also varies as a function of time. The amount of toner conveyed therefore increases.

Further, the electric field, which varies as a function of time, also affects the accumulation of toner on the toner conveying member 2, so that the toner is released from the toner conveying member 2. Furthermore, the adherence of toner to the toner conveying member 2 can be decreased.

Thus, the voltage applied by the first-potential application mechanism 11 is an overlapping voltage of a DC voltage and an AC voltage so that the toner vibrates as a result of the electric field generated by AC voltage. Because of the toner vibration, the toner is easily released from the carrier and moves from the developer carrier 3 to the toner conveying member 2. As a result, there is an increase in the amount of toner conveyed. Moreover, the electrostatic force applied to the toner that is tentatively adhered to the surface of the toner conveying member 2 decreases so as to prevent the adherence of the toner to the toner conveying member 2.

Again, the voltage applied to the developer carrier 3 by the first-potential application mechanism 11 is shown in FIG. 6, and the voltage with one of the phases applied to the developer carrier 3 by the second-potential application mechanism 12 is shown in FIG. 8. A frequency $f_1$ of the AC component applied by the first-potential application mechanism 11 is determined to have a smaller value than a product of a frequency $f_0$ of the AC component applied by the second-potential application mechanism 12 and a number of phase n applied to the electrodes of the toner conveying member 2 (i.e., $f_0 \times n$).

By applying an overlapping voltage of a DC voltage and an AC voltage to the developer carrier 3, the toner vibrates with the frequency $f_1$ of the AC component of the voltage applied by the first-potential application mechanism 11. The toner is conveyed on the surface of the developer carrier 2 with a toner conveying speed v2 expressed as ($r \times n \times f_0$).

When the conveying speed is less than the vibration speed of the toner, the toner is released from the carrier by the vibration and is moved to the toner conveying member 2 by the electrostatic force. However, the toner may adhere tentatively to the toner conveying member 2 due to the smaller conveying speed.

At each timing of the change of the voltage applied to the electrodes changing with $f_0$, the toner which is adhered to the toner conveying member 2 is subject to a repulsive electrostatic force. Then, the toner is released from the toner conveying member 2 and starts to vibrate due to the vibrational electric field with the frequency $f_1$. During this vibrational motion, a portion of toner may adhere again to the carrier.

As described, when the conveying speed v2 is less than the vibration speed of the toner, the toner moved to the toner conveying member 2 may not be conveyed efficiently on the toner conveying member 2. When the conveying speed v2 is larger than the vibration speed of the toner, the toner which is released from the carrier by the vibration is moved to the toner conveying member 2 by the electrostatic force and is conveyed on the surface of the toner conveying member 2 easily.

Specifically, the frequency $f_1$ of the AC component applied by the first-potential application mechanism 11 is determined to have a smaller value than a product of a frequency $f_0$ of the AC component applied by the second-potential application mechanism 12 and n that is a number of phases applied to the electrodes of the toner conveying member 2 so that the toner supplied is conveyed efficiently.

Figure 17:
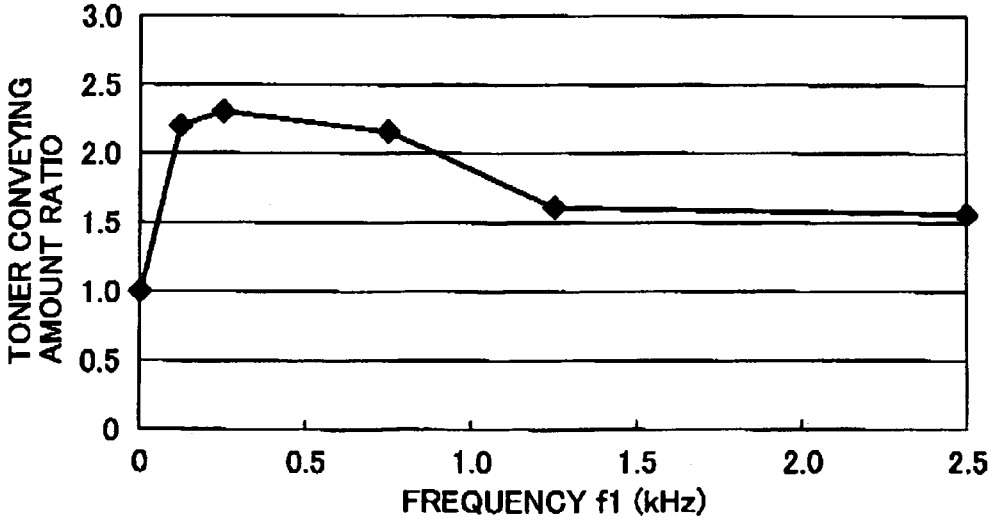
FIG. 17 is a graph illustrating a dependence of a conveying toner amount ratio to the toner conveying member with the frequency of an AC component applied by the first potential application mechanism.

FIG. 17 is a graph illustrating a dependence of a conveying toner amount ratio to the toner conveying member 2 with the frequency $f_1$ of the AC component applied by the first-potential application mechanism 11. In this case, the conveying toner amount ratio is a ratio to the conveying toner amount when the frequency $f_1$ is zero (i.e., the case when a DC voltage is applied.)

As shown in FIG. 17, the conveying toner amount ratio becomes greater than "1", (i.e., $f_1$ is larger than "1"), if the AC voltage is superimposed. However, the conveying toner amount ratio decreases by setting the frequency from 3 KHz to 5 KHz, because the vibration speed of the toner becomes larger than the conveying speed v2.

Thus, by setting the frequency of the voltage applied by the first-potential application mechanism 11 less than the frequency of the voltage applied by the second-potential application mechanism 12, the conveying speed becomes larger than the vibration speed of the toner. Then, the toner released from the carrier by the vibration can be put on the conveying electric field efficiently. Consequently, there is an increase in the amount of toner conveyed.

The potential difference of the peak value V1*pp* of AC voltage applied by the first-potential application mechanism 11, shown in FIG. 6, is set to be greater than the absolute value of the DC voltage |V1*dc*|. If the potential difference of the peak value V1*pp* of AC voltage is set to be less than the absolute value of the DC voltage |V1*dc*|, an electric field by the DC voltage may increase and the electric field may decrease by an amplitude of the AC voltage. In this case, the toner vibration decreases and an effect of superimposition of AC voltage is not obtained.

On the contrary, by setting the difference of the peak value V1*pp* of AC voltage larger than the absolute value of the DC voltage |V1*dc*|, the amplitude of AC voltage increases. As a result, the toner vibration increases so that that the toner is released from the magnetic carrier easily.

Figure 18:
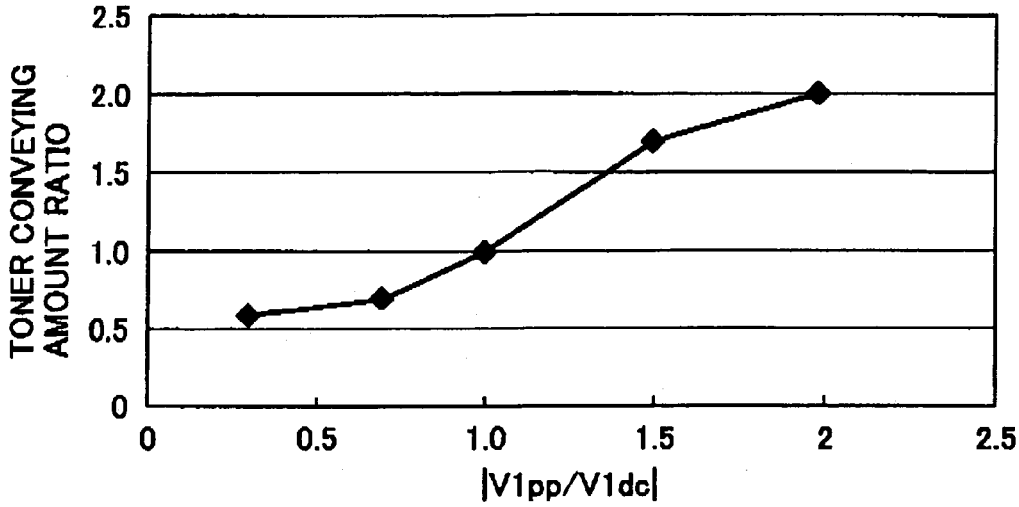
FIG. 18 is a graph illustrating a dependence of the conveying toner amount ratio to the ratio of the AC component and a DC component applied by the first potential application mechanism.

FIG. 18 is a graph illustrating a dependence of the conveying toner amount ratio with the ratio of V1*pp* and |V1*dc*|, (i.e., |V1*pp*/V1*dc*|), while changing the voltage V1*pp* at a constant value of the |V1*dc*|. In this case, the conveying toner amount ratio is a ratio of a conveying toner amount to the conveying toner amount at the |V1*pp*/V1*dc*| equal to "1". As shown in FIG. 18, when |V1*pp*/V1*dc*| is "0.3", an effect of the superimposition with an AC voltage is not obtained because the potential difference of the peak value V1*pp* is too small. The conveying toner amount ratio is being increased and becomes greater than "1", when |V1*pp*/V1*dc*| is being increased. This is the effect of the vibration of the toner by V1*pp*.

Thus, when an absolute value of the potential difference between a maximum value and a minimum value of the AC component of the voltage applied by the first-potential application mechanism 11 is less than an absolute value of the DC component of the voltage, the amplitude of AC voltage decreases and an effect of the superimposition of the AC voltage can not be obtained.

Therefore, by setting the absolute value of the potential difference between a maximum value and a minimum value of the AC component of the voltage applied by the first-potential application mechanism 11 greater than an absolute value of the DC component of the voltage, the amplitude of AC voltage increases and the toner supplying amount can be increased.

The AC component of the voltage applied to the developer carrier 3 by the first-potential application mechanism 11 is a rectangular wave in this exemplary embodiment. Using the rectangular wave, the electric field between the toner conveying member 2 and the developer carrier 3 can be changed rapidly. By the rapid change of the electric field, the toner receives a rapid change of the electrostatic force from the electric field and is therefore easily released from the magnetic carrier. Consequently, the toner amount supplied to the toner conveying member 2 can be increased.

During one cycle of the rectangular wave, it is determined that a rate of another greater portion of the DC component of the voltage applied by the second-potential application mechanism 12 is greater than a rate of a smaller different portion of the DC component of the voltage applied by the second-potential application mechanism 12. For example, the voltage applied by the second-potential application mechanism 12 shown in FIG. 8 and a voltage applied by the first-potential application mechanism 11 shown in FIG. 6 are set in relation to one another as shown in FIG. 19.

Figure 19:
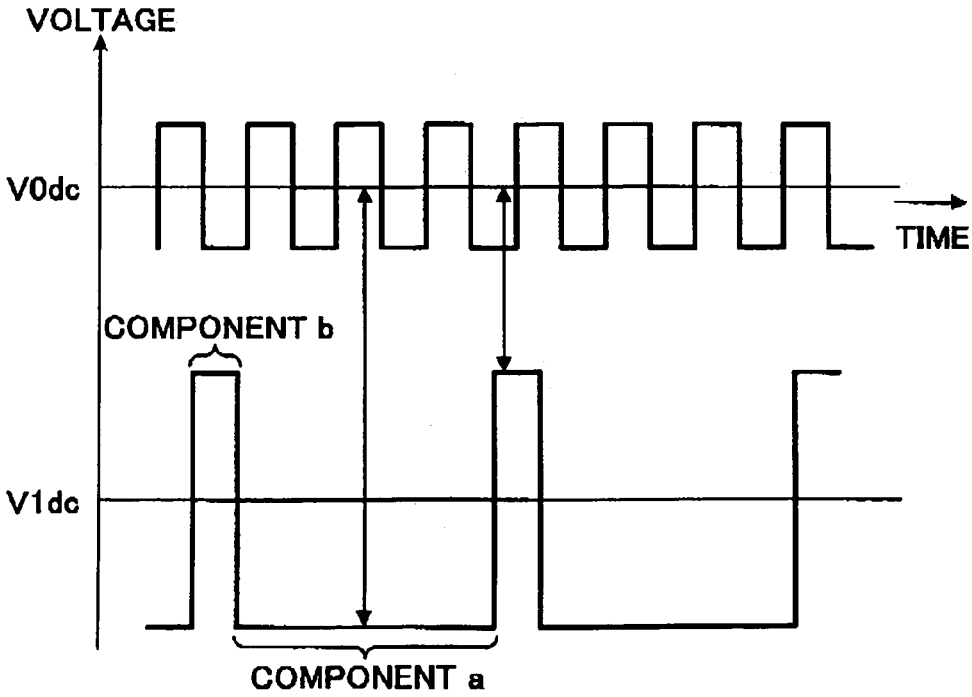
FIG. 19 illustrates a relation between the AC component applied by the first potential application mechanism and the DC component applied by the second potential application mechanism.

The DC component applied by the second-potential application mechanism 12 is V0*dc* in FIG. 19. Therefore, the another greater portion of the DC component of the voltage applied by the second-potential application mechanism 12 is a component a. The smaller different portion of the DC component of the voltage applied by the second-potential application mechanism 12 is a component b.

When the component a is applied, the electric field between the toner conveying member 2 and the developer carrier 3 is large. Conversely, when the component b is applied, the electric field between the toner conveying member 2 and the developer carrier 3 is small. When the electric field between the toner conveying member 2 and the developer carrier 3 is large, the toner receives a large electrostatic force and is easy to release from the magnetic carrier. Specifically, the toner supply amount can be increased by setting the rate of the component a greater than the rate of the component b, as shown in FIG. 19.

Figure 20:
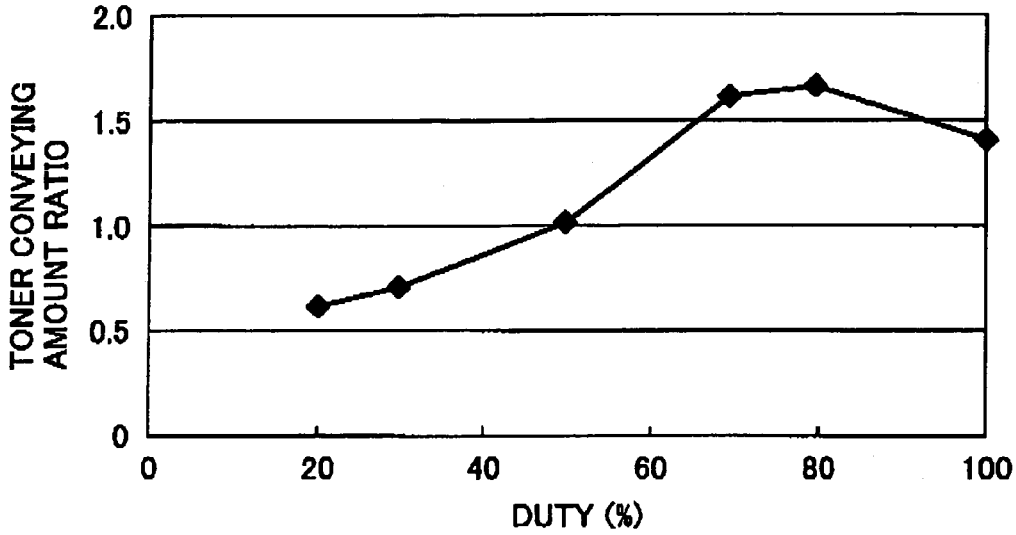
FIG. 20 is a graph illustrating a dependence of the conveying toner amount ratio with a duty of a rectangular wave applied by the first-potential application mechanism.

FIG. 20 is a graph illustrating a dependence of the conveying toner amount ratio with the duty of the rectangular wave applied by the first-potential application mechanism 11. In this case, the conveying toner amount ratio is a ratio of a conveying toner amount to the conveying toner amount when the duty is 50%. When the duty is less than 50%, the rate of the component a is less than the rate of the component b.

As shown in FIG. 20, the conveying toner amount ratio is less than "1" when the duty ratio is 20% or 30%. And, the conveying toner amount ratio becomes larger than "1" when the duty ratio is larger than 50%. However, when the duty ratio is 100% (i.e., when only DC voltage is applied), the toner conveying amount decreases. This is because the toner supply amount decreases as there is no vibration effect as there is no application of an overlapping voltage of a DC voltage and an AC voltage. With this result, it is found that 80% is the best duty ratio.

In the above exemplary embodiment, a voltage applied by the first-potential application mechanism is an overlapping voltage of a DC voltage and an AC voltage is used with the two-component developer. However, similar configuration can be applied to a system using the mono-component developer.

In the case using the two-component developer, a strong electric field which overcomes the electrostatic force to adhere the toner to the magnetic carrier is generated. The toner is released from the magnetic carrier by electric field and then is supplied efficiently to the toner conveying member 2.

In the case using the mono-component developer, toner is adhered directly to the developer carrier. Further, when magnetic toner is used, the magnetic toner is adhered to the developer carrier by the magnetic force of magnet arranged in the developer carrier. When non-magnetic toner is used, the non-magnetic toner is adhered to the developer carrier by the electrostatic force generated by contact friction with the developer carrier.

Similarly, in the case using mono-component developer, a strong electric field is generated, which overcomes the electrostatic force, to adhere the toner to the developer carrier. The toner is released from the developer carrier by electric field and then is supplied efficiently to the toner conveying member 2.

Further, a voltage applied by the first-potential application mechanism as an overlapping voltage of a DC voltage and an AC voltage is used also in the mono-component developer system. Moreover, similar configurations such as a frequency of the AC voltage, a relation between V1*pp* and V1*dc* and duty of the rectangular wave can be applied to the mono-component developer system.

A distance between the toner conveying member 2 and the developer carrier 3 is now described. The disclosure can be applied to both cases where the developer on the developer carrier 3 may touch the toner conveying member 2 and where the developer on the developer carrier 3 does not touch the toner conveying member 2.

In the case where the developer on the developer carrier 3 may touch the toner conveying member 2, a distance between the toner conveying member 2 and the developer carrier 3 is small. Then, the electric field is large and the electrostatic force is large. Therefore, the toner is easily released from the carrier (in the case of the two-component developer system) or from the developer carrier 3 (in the case of the mono-component developer system).

Moreover, in the case of the two-component developer system, the toner is released from the carrier by an impact force generated when magnetic spikes arranged on the developer carrier 3 impact the toner conveying member 2. As a result, the toner supply amount increases.

Thus, taking the configuration in which the developer on the developer carrier 3 may touch the toner conveying member 2 at the position where the toner conveying member faces the developer carrier, the distance between the toner conveying member 2 and the developer carrier 3 is small so that the electric field becomes large. As a result, the toner supply amount increases.

In the configuration where the developer on the developer carrier 3 does not touch the toner conveying member 2, the distance between the toner conveying member 2 and the developer carrier 3 is large and the electric field decreases. In this case, the voltage applied by the first-potential application mechanism is set to be great and similar electric field is applied at the case in which the developer on the developer carrier 3 may touch the toner conveying member 2. Further, the configuration helps to prevent degradations of the surface of the toner conveying member 2 caused by damage because of scratches, etc, as there is no contact between the toner conveying member 2 and the developer carrier 3.

A relation between a toner conveying direction at the toner conveying member 2 and a toner moving direction (rotation direction) at the developer carrier 3 is now described. The direction to which the developer carrier 3 conveys the developer is opposite a direction to which the toner conveying member 2 conveys the toner at the position where the toner conveying member 2 faces the developer carrier 3. In this configuration, the toner which is released from the magnetic carrier (two-component developer) or from the developer carrier (mono-component developer) is not captured by the magnetic carrier or by the developer carrier. Then the toner is conveyed by the conveying electric field.

Figure 21:
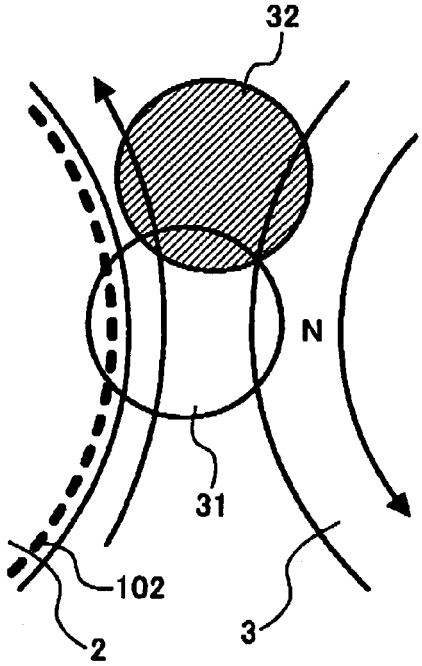
FIG. 21 is a schematic drawing showing an exemplary embodiment, using a two-component developer, in which a rotation direction of the developer carrier is opposite a toner conveying direction at the toner conveying member.

Referring to the FIG. 21, an exemplary embodiment in which a rotation direction of the developer carrier 3 is opposite a toner conveying direction of the toner conveying member 2 is now described. The developer carrier 3 rotates in a counterclockwise direction and toner is conveyed also in a counterclockwise direction in the exemplary embodiment shown in FIG. 21. The conveying direction of the developer on the developer carrier 3 is opposite a toner conveying direction on the toner conveying member 2.

In FIG. 21, the magnet arranged in the developer carrier 3 is configured to generate a peak level of magnetic force at a most adjacent region (nearest region) 31 shown in FIG. 21, where the developer carrier 3 faces the toner conveying member 2. In the nearest region 31, the carrier forms magnetic spike along the magnetic curve.

There is another position where the magnetic spike occurs and is located at an upstream region 32 in a rotation direction of the toner conveying member 2 from the nearest region 31. At a further upstream region 32 from the nearest region 31 however, a direction of the magnetic curve is directed to have a smaller angle from the tangential projection of the developer carrier 3. The direction of the magnetic curve at the upstream region 32 where the magnetic spike occurs, a direction of the magnetic curve is directed to have a larger angle due to a distribution of magnets arranged in the developer carrier 3.

The magnetic spike occurs at the region 32 because the carrier forms the magnetic spike along the magnetic curve. The formation of the magnetic spike occurs at the same time of the rotation of the developer carrier 3. The toner is adhered by the electrostatic force to the magnetic carrier which forms the magnetic spike and receives a large centrifugal force. The centrifugal force and the electrostatic force due to the electric field between the toner conveying member 2 the developer carrier 3 overcome the electrostatic force between the toner and the magnetic carrier. The toner is released from the magnetic carrier and is conveyed to the toner conveying member 2.

When a direction with which the toner is conveyed on the toner conveying member 2 is the same direction with which the developer is conveyed on the developer carrier 3 at a position where the toner conveying member faces the developer carrier, the toner moved to the toner conveying member 2 is attracted and conveyed to the region 31. The toner contacts the developer at the nearest region 31 because the toner "hops" while being conveyed. Therefore, a portion of the toner may be captured by the developer.

The conveying speed at the toner conveying member 2 is larger than the speed which the developer carrier 3 conveys the developer. In this circumstance, the hopping toner goes through the developer on the developer carrier 3. At the nearest region 31, the toner may impact the developer many times. Thus, it takes a relatively long time for the toner to go though the nearest region 31.

When a direction with which the toner is conveyed on the toner conveying member 2 is opposite the direction in which the developer is conveyed on the developer carrier 3 at a position where the toner conveying member faces the developer carrier, the toner moved to the toner conveying member 2 at the upstream region 32 shown in FIG. 21 is not conveyed to the nearest region 31. For this reason, the toner does not impact the developer and the amount of conveyed toner increases.

Thus, by making the direction in which the toner is conveyed on the toner conveying member 2 opposite the direction in which the developer is conveyed on the developer carrier 3, a decline in the amount of the toner conveyed is prevented, because there are no disturbances during conveyance of the toner.

Figure 22:
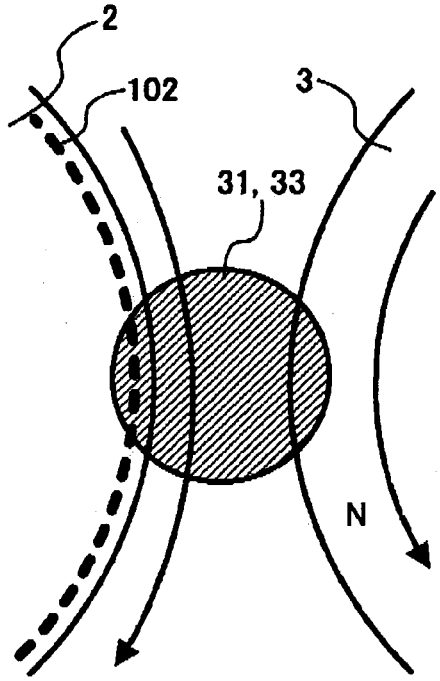
FIG. 22 is a schematic drawing showing another exemplary embodiment using a two-component developer, in which a rotation direction of the developer carrier is the same as a toner conveying direction at the toner conveying member.

Referring to the FIG. 22, an exemplary embodiment using the two-component developer in which a rotation direction of the developer carrier 3 is the same as a conveying direction of the toner conveying member 2 is now described. In this exemplary embodiment, a position where the toner conveying member faces the developer carrier is arranged at an upper position from a position where the magnet arranged in the developer carrier 3 generates a peak level of the magnetic force.

Specifically, the position where the toner conveying member faces the developer carrier is set to be the position 32 where the magnetic spike occurs and the rotation direction of the developer carrier 3 is the same direction as the conveying direction of the toner conveying member 2.

In FIG. 22, the toner conveying member 2 faces the developer carrier 3 at the upper position 31(32) from a position where the magnet arranged in the developer carrier 3 generates a peak level of the magnetic force. At the upper position 31(32), the magnetic spike occurs. In this region, the toner adhered to the magnetic carrier receives the centrifugal force and impact force when the magnetic spike occurs and the electrostatic force due to the electric field between the toner conveying member 2 and the developer carrier 3. Then, the toner is released from the magnetic carrier and is moved to the toner conveying member 2.

Since the electric field in the case of FIG. 22 is larger than the electric field in FIG. 21 (i.e., a distance between toner conveying member 2 and the developer carrier 3 is decreased), a larger amount of toner is supplied to the toner conveying member 2. The conveyed toner is attracted to and "hops" on the toner conveying member 2. The toner is not disturbed by the developer on the developer carrier 3 because of the roundness of the toner conveying member 2 and the developer carrier 3, so that the toner is conveyed on the surface of the toner conveying member 2.

Because the rotational direction is the same as the toner conveying direction, the toner moved to the toner conveying member 2 has a speed component to the conveying direction of the toner conveying member 2 so that the toner can be conveyed by smoothly receiving the conveying electric field. As a result, the amount of conveyed toner increases.

Thus, a position where the toner conveying member faces the developer carrier is set to locate a position where the toner is most efficiently supplied from the developer carrier. Further a direction in which the toner is conveyed on the toner conveying member 2 is set to be the same as that in which the developer is conveyed on the developer carrier 3.

The toner supplied to the toner conveying member 2 is not disturbed by the developer on the developer, and is conveyed on the surface of the toner conveying member 2 by the conveying electric field. Moreover, since the direction in which the toner is conveyed on the toner conveying member 2 is the same direction in which the developer is conveyed on the developer carrier 3, the toner moved to the toner conveying member 2 is smoothly affected by the conveying electric field so that the toner is conveyed easily.

Figure 23:
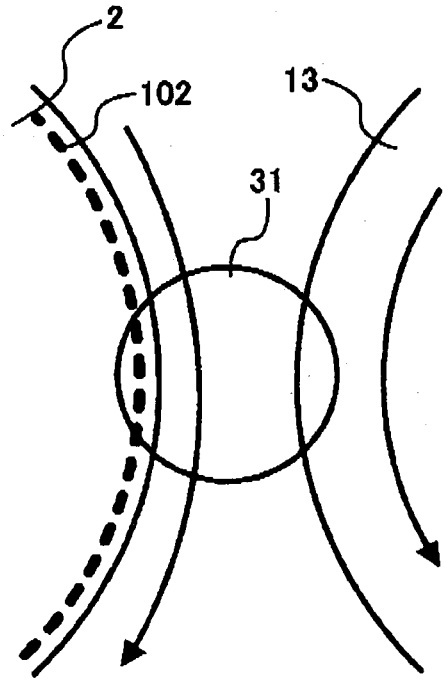
FIG. 23 is a schematic drawing showing another exemplary embodiment, using a mono-component developer, in which a rotation direction of the developer carrier is the same as a toner conveying direction at the toner conveying member.

Referring to the FIG. 23, another exemplary embodiment using mono-component developer in which a rotation direction of the developer carrier 3 is the same as a conveying direction of the toner conveying member 2 is now described.

In the case using mono-component developer, most of the toner is moved to the toner conveying member 2 at the nearest region 31 between the developer carrier 13 and the toner conveying member 2. The toner moved is attracted by and "hops" because of the conveying electric field. When the direction in which the developer is conveyed on the developer carrier 13 is the same direction in which the toner is conveyed on the toner conveying member 2 at the nearest region 31, the toner moved to the toner conveying member 2 has a speed component to the conveying direction of the toner conveying member 2 so that the toner can be conveyed by smoothly receiving the conveying electric field. As a result, there is an increase in the amount of toner conveyed.

A portion of the toner is moved to the toner conveying member 2 at the upstream region in a rotation direction of the developer carrier 13 from the nearest region 31. When the direction in which the developer is conveyed on the developer carrier 13 is the same direction in which the toner is conveyed on the toner conveying member 2, the toner moved to the toner conveying member 2 is attracted and "hops" to the nearest region 31. At the nearest region 31, the conveyed toner adheres to the developer carrier 13 again and impacts the toner on developer carrier 3. The efficiency with which the toner is conveyed decreases.

Figure 24:
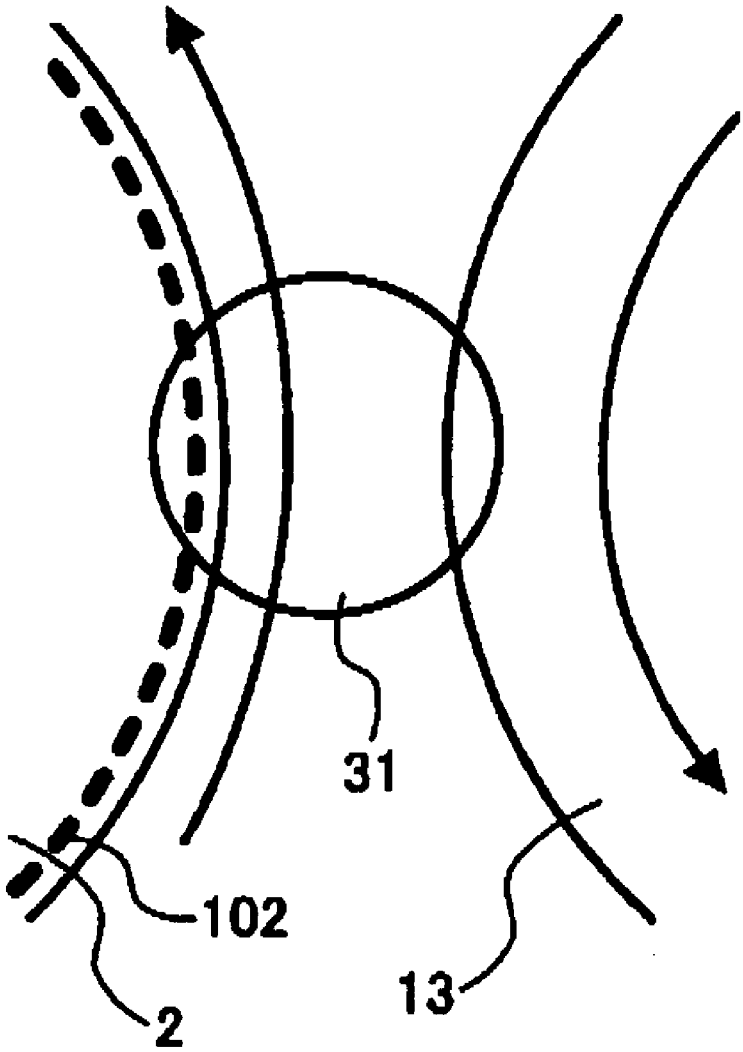
FIG. 24 is a schematic drawing showing another exemplary embodiment, using mono-component developer, in which a rotation direction of the developer carrier is opposite a toner conveying direction at the toner conveying member.

Referring to the FIG. 24, another exemplary embodiment using mono-component developer in which a rotation direction of the developer carrier 3 is opposite a conveying direction of the toner conveying member 2 is now described. When the direction in which the developer is conveyed on the developer carrier 13 is opposite a direction in which the toner is conveyed on the toner conveying member 2, a portion of the toner moved to the toner conveying member 2 at the upstream region in a rotation direction of the developer carrier 13 from the nearest region 31 is conveyed to the reverse direction against the nearest region 31. Thus, the toner does not adhere to the developer carrier 13 again and does not impact the toner on developer carrier 13, because the toner conveyed to the nearest region 31 is conveyed in the opposite direction against the nearest region 31.

Figure 25:
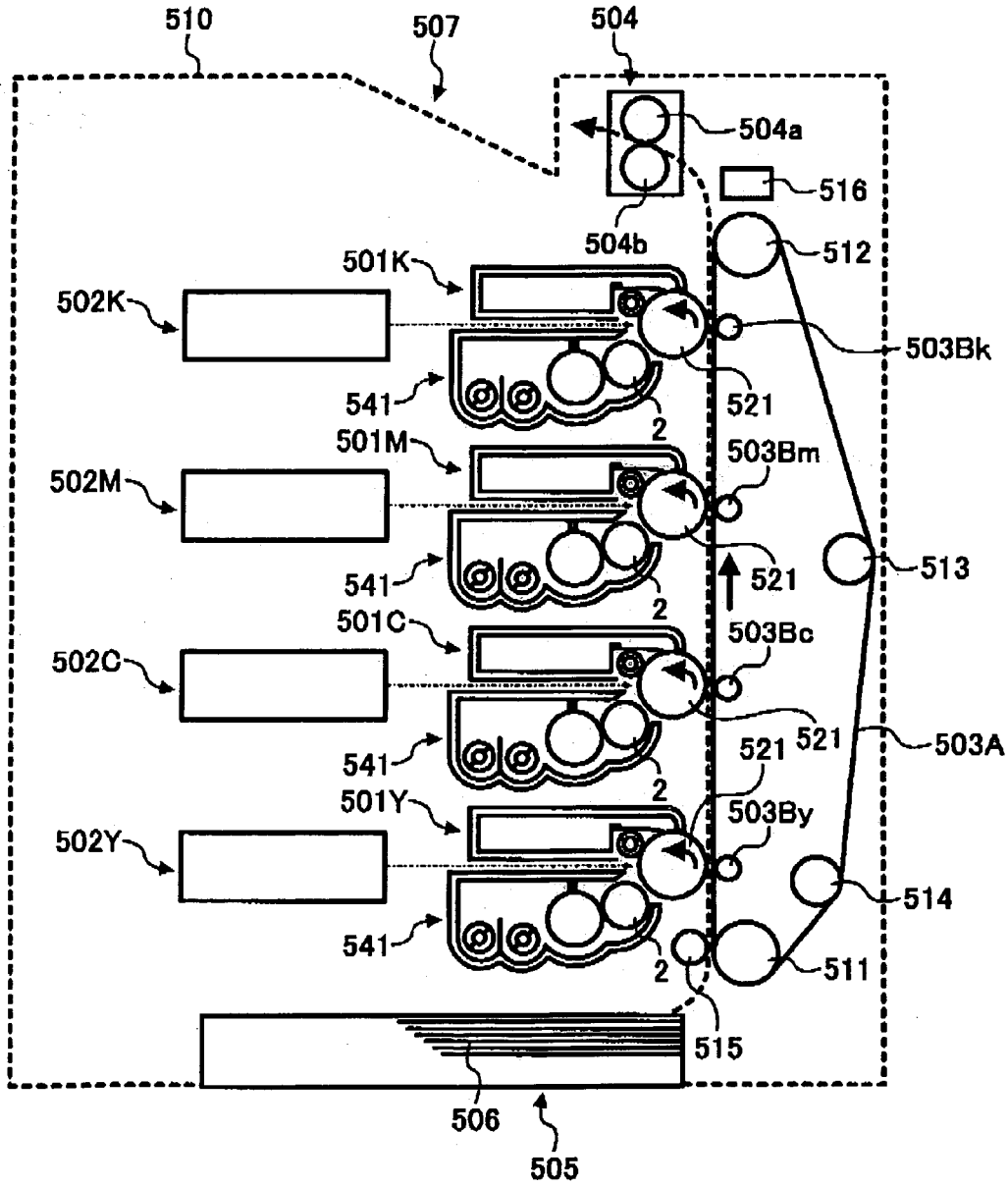
FIG. 25 is a schematic drawing showing a side view of the first exemplary embodiment that includes process cartridges.

Referring to FIG. 25, the exemplary embodiment of the image forming apparatus including process cartridges is now described. The image forming apparatus includes process cartridges 501, (501K, 501M, 501C and 501Y respectively) light-writing units 502, (502K, 502M, 502C and 502Y respectively) a conveying belt 503A, transfer rollers 503B, (502Bk, 502Bm, 502Bc and 502By respectively) a fixing apparatuses 504 and a paper cassette 505. The process cartridge 501 includes an image carrier, a charging mechanism and a developing mechanism.

The process cartridges 501 include a cleaning mechanism and forms black, magenta, cyan and yellow color toner image. The transfer roller 503B faces the process cartridge 501 and holds the conveying belt 503A with the process cartridge 501. The paper cassette 505 stores papers 506 to be transferred.

The light-writing unit 502, (502K, 502M, 502C and 502Y respectively), is configured to form an electrostatic latent image on an image carrier after charging in accordance with the image forming information. Generally, the light-writing unit can include a scanning apparatus using a polygon mirror or LED (light emitting diode) array.

The conveying belt is extended among a conveying roller 511, a driven roller 512 and tension rollers 513, 514 and is driven to rotate in a direction shown by an arrow. An absorption roller 515 is arranged to face the conveying roller 511 to capture the paper onto the conveying belt 503A. A P-sensor 513 is arranged at the exit side of the conveying belt 503A to detect an image pattern formed on the conveying belt 503A.

The transfer roller 503B is an elastic roller and includes at least a core metal covered with a conductive elastic layer. Elastic materials such as polyurethane, ethylene-propylene-diolefin-polyethylene (EPDM) are used to form the elastic layer. The conductivity is determined, such that the roller has a resistance of $10^6$ to $10^{10}$ Ωcm (medium-range resistance) by mixing and distributing conductive adhering materials such as carbon black, zinc oxide and tin dioxide. The fixing apparatus 504 includes a heating roller 504*a* and a pressuring roller 504*b*.

In a normal mode of operation in the image forming apparatus, the paper 506 is absorbed onto the conveying belt 503A with a predetermined voltage applied to the absorption roller 515. Then, the paper 506 held on the conveying belt 503A is carried in accordance of the movement of the conveying belt 503A.

During the movement of the conveying belt 503A, each color toner image is transferred by each process cartridge sequentially. As a result, a color image is formed on the paper 506. When the paper 506 arrives at the fixing apparatus 504 passing through a region of the conveying belt 503A, the toner image on the paper 506 is fixed by heat and pressure by the heating roller 504*a* and the pressuring roller 504*b*. Finally, a color image on the paper 506 is visualized. After fixing, the paper 506 is output to a paper holding section 507 arranged at an upper portion of the main body 510 of the image forming apparatus.

In an adjustment mode operation in which color sledge and color density are adjusted, the process cartridge directly forms a toner image of a predetermined adjustment pattern on the conveying belt 503A at first. Next, the toner image pattern is detected by the P-sensor 516. Then, a writing timing and a bias for development are changed in accordance with the detection result so as to get a best color image.

The toner pattern charged with a polarity on the conveying belt 503A is regulated by a bias voltage applied to the absorption roller 515. After that, the toner is salvaged into the process cartridge by the voltage applied to the transfer roller 503B.

Figure 26:
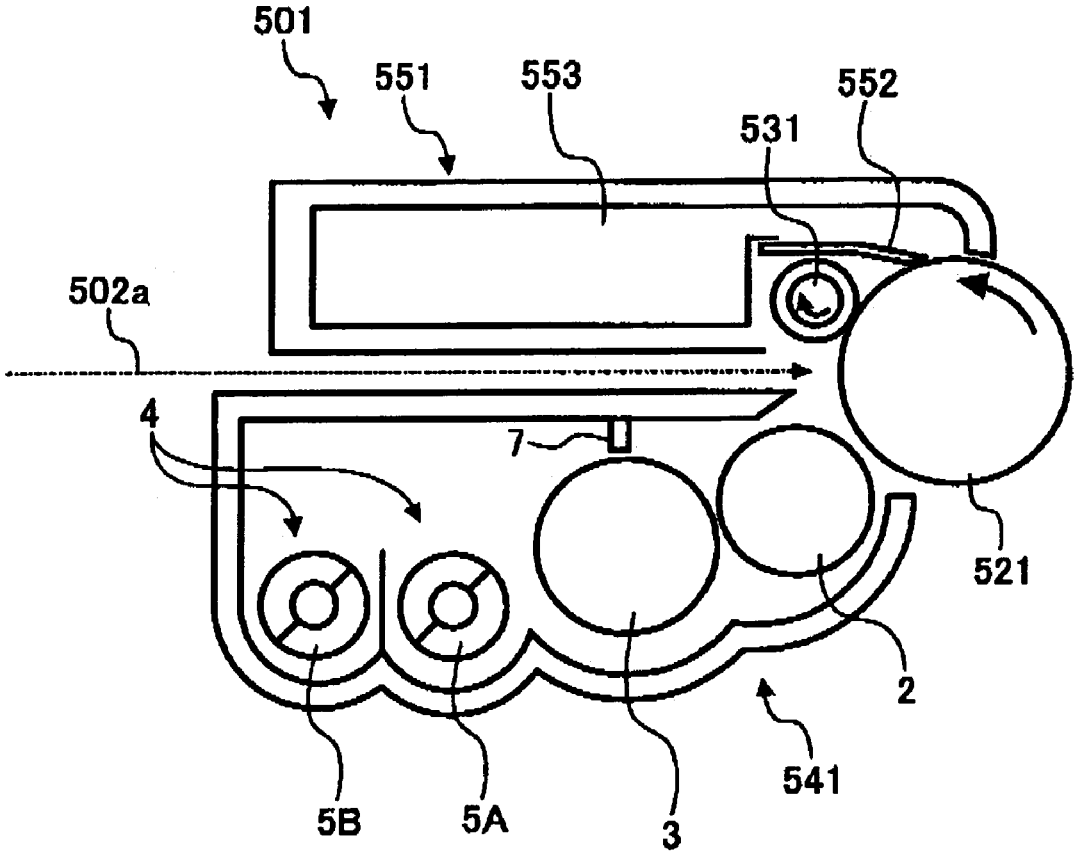
FIG. 26 is a schematic drawing showing a side view of the process cartridge.

The process cartridge 501 used in the exemplary embodiment is now described using FIG. 25. FIG. 26 is a detail view of the process cartridge 501. The process cartridge 501 includes an image carrier 521, a contact charging member 531, a developing unit 541 and a cleaning member 551.

The image carrier 521 is a negatively charged organic photosensitive member and is configured to rotate by a rotation drive mechanism (not shown) in a direction indicated by the arrow. A blowing urethane layer is formed on the core metal of the contact charging member 531. The blowing urethane layer has a medium-range resistance with a urethane resin, carbon black as a conductive particle, a sulfurizing agent and a blowing agent. Thus, the contact charging member 531 is a charged flexible roller.

Rubber materials such as an urethane, an ethylene-propylene-diolefin-polyethylene (EPDM), a butadiene-acrylonitrile rubber (NBR), a silicon rubber and an isoprene rubber or a blowing material can be used as a layer having a medium-range resistance mixing the conductive materials such as the carbon black and metal oxide for the adjustment of the resistance. The cleaning member 551 includes a cleaning blade 552 and a recycle toner storage 553. The cleaning blade 552 is arranged to touch the image carrier 521 in a counter direction of the rotation of the image carrier 521.

The operation of the process cartridge is now described. The image forming apparatus of the exemplary embodiment is a multi functional peripheral which operates as a copier and a printer. When the image forming apparatus operates as a copier, image information is read by a scanner and is transformed into a writing signal after various image forming processes such as A/D (analog/digital) transformation, MTF (modulation transfer function) adjustment, gradation processing and so on.

When the image forming apparatus operates as a printer, image information having a page description language format or bitmap format which is sent from a computer is transferred to a writing signal. The image carrier 521 starts to rotate in a counterclockwise direction shown by an arrow in FIG. 25 and moves with a predetermined surface speed.

The contact charging member 531 is drive to rotate by the rotation of the image carrier 521. A DC voltage of −100 v and an AC voltage of an amplitude of 1200 v with frequency 2 kHz are applied to the core metal of the contact charging member 531. As a result, the surface of the image carrier 521 is charged with −100 v.

The light-writing unit 502 performs an exposure process by irradiating a laser light to the charged image carrier 521 in accordance with the writing data. Since potentials on an imaging are changed by irradiating laser light, potential differences are generated between the irradiated area and the non-irradiated area. Thus, an electrostatic latent image is formed by the contrast of the potential differences.

The electrostatic latent image formed on the image carrier 521 is developed by the developing unit 541 and is visualized on the image carrier 521 by adhering the toner on the electrostatic latent image. The paper 506 is supplied from the paper cassette 505 at the just timing when the toner image formed on the image carrier 521 is conveyed to a transfer portion where the transfer roller 503B faces the image carrier 521. The toner image on the image carrier 521 is transferred to the paper 506 by the voltage applied to the transfer roller 503B. The toner image held on the paper 506 is fixed by the fixing apparatus 504. Finally, a color image is formed on the paper 506.

Figure 27:
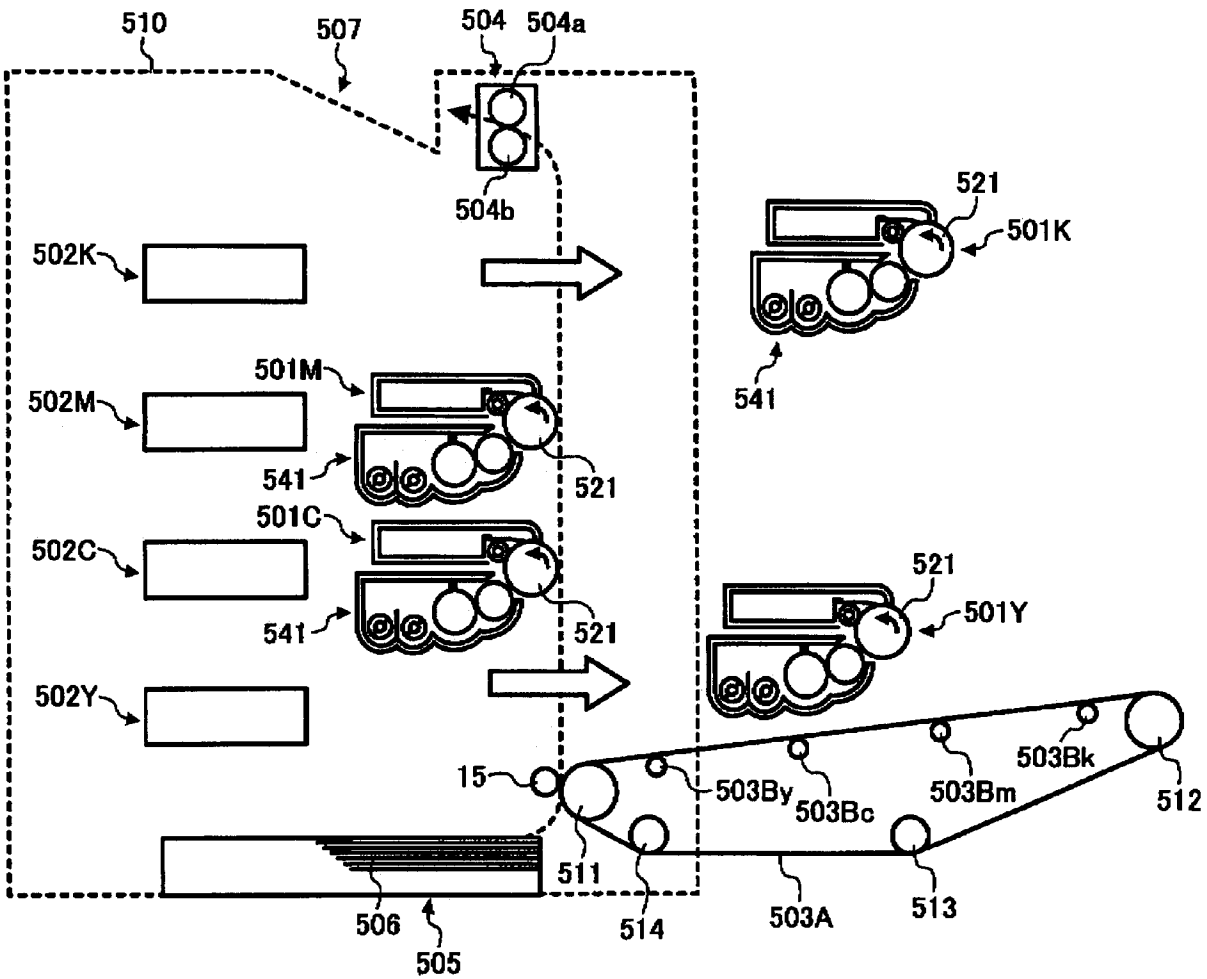
FIG. 27 is a schematic drawing showing a side view of the first exemplary embodiment illustrating detachment of the process cartridge.

The toner which is not transferred and stayed on the image carrier 521 is cleaned by the cleaning apparatus 551 so that the surface of the image carrier 521 is used for the next image forming operation. Each process cartridge is detachably arranged with the main body 510 of the image forming apparatus. The conveying belt 503A is released to an outside of the apparatus, as shown in FIG. 27. Therefore, the process cartridge can be easily detached from the main body 510 of the image forming apparatus so that the user can exchange the process cartridge.

Figure 28:
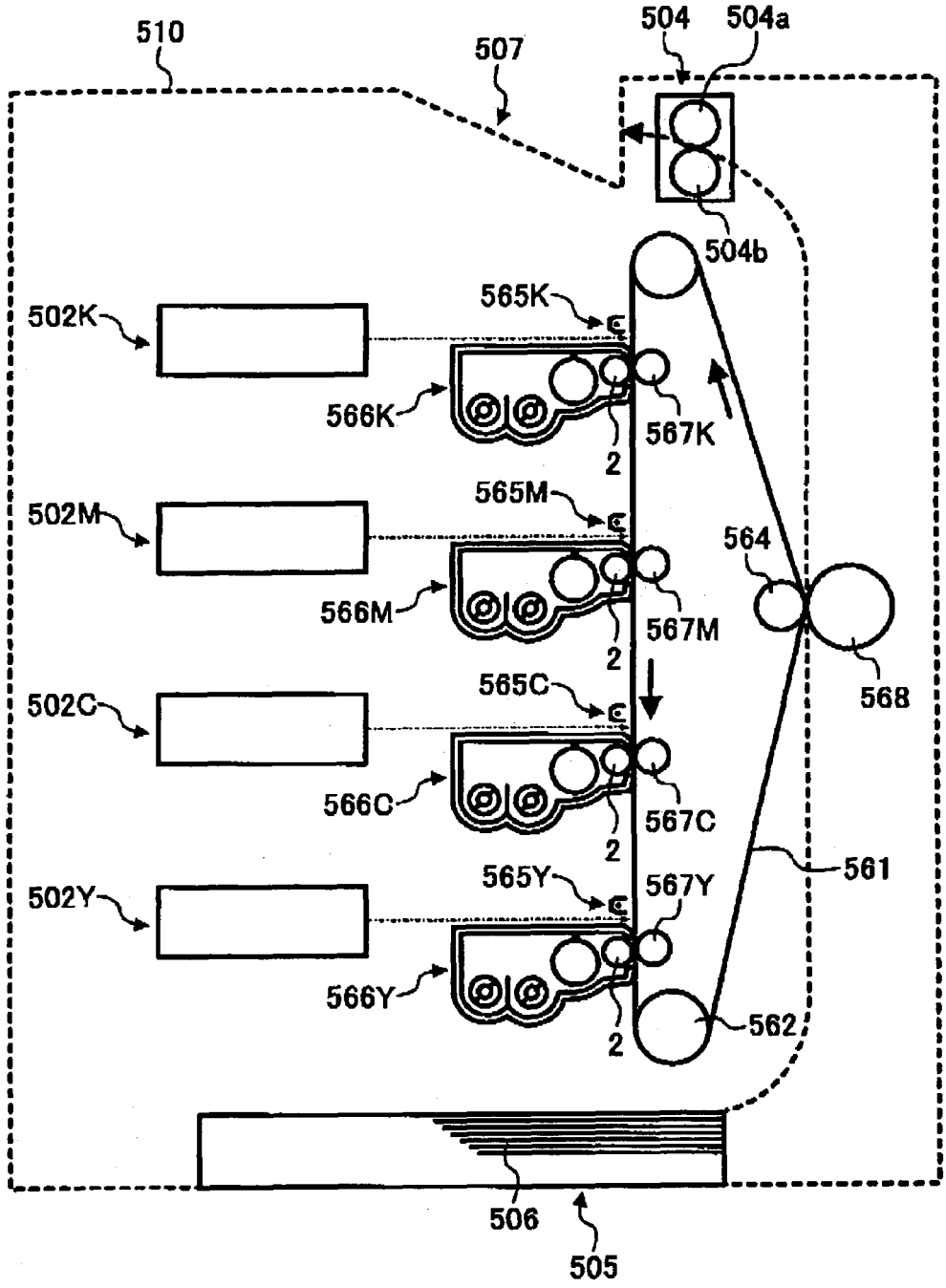
FIG. 28 is a schematic drawing showing a side view of the second exemplary embodiment that includes developing cartridges.
Figure 29:
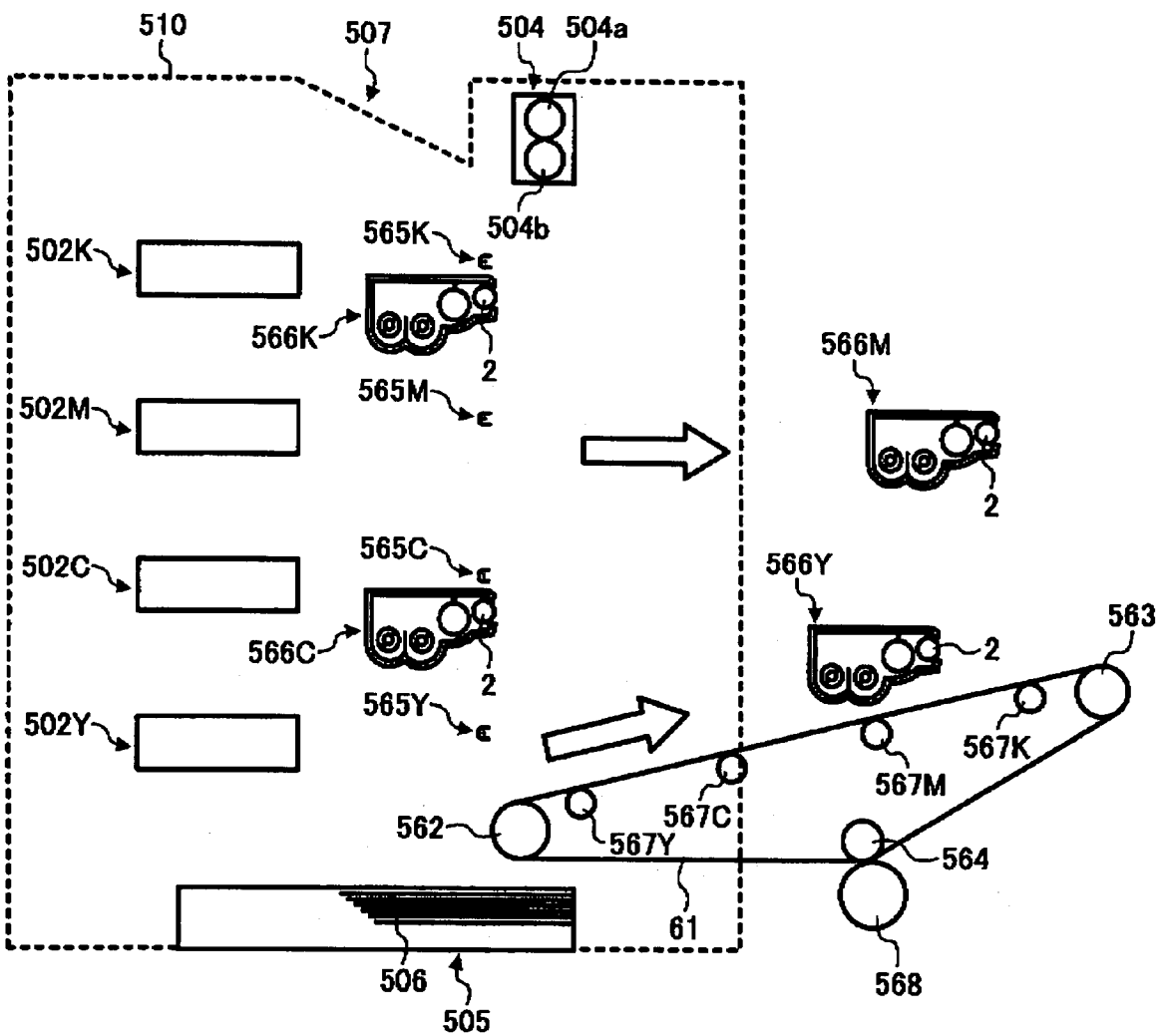
FIG. 29 is a schematic drawing showing a side view of the second exemplary embodiment illustrating detachment of the developing cartridge.

FIGS. 28 and 29 illustrate a second exemplary embodiment of the image forming apparatus. The image forming apparatus includes an image carrier belt 561, which is formed with a negatively charged organic photosensitive member. The image carrier belt 561 extends among a driving roller 562, a driven roller 563 and a transfer-facing roller 564, and is driven to rotate by a rotation drive mechanism in a direction shown by arrows. The transfer-facing roller 564 faces the transfer roller.

Each charging apparatus 565 (565K, 565M, 565C and 565Y) faces each developing cartridge 566 (566K, 566M, 566C and 566Y) at both sides of the image carrier belt 561 respectively. During the movement of the image carrier 521, each color toner image is superimposed so as to form a full color image.

A facing roller 567 (567K, 567M, 567C and 567Y) is arranged at each corresponding position to face each process cartridge via the image carrier belt 561. Further, a transfer roller is arranged to face the transfer-facing roller 564 via the image carrier belt 561.

The charging apparatus 565 is configured to charge the surface of the image carrier belt 561 uniformly. In this exemplary embodiment, a corona discharge method is employed. Using a non-contact method like the corona discharging method, the image carrier belt 561 can be charged without disturbing the toner image formed by the developing cartridge 566 located upstream.

The developing cartridge 566 is similar to the developing unit described above. The image carrier belt 561 is released to an outside of the apparatus, as shown in FIG. 29. Therefore, the developing cartridge 566 can be easily detached from the main body 510 of the image forming apparatus so that the user can exchange the developing cartridge.

In this image forming apparatus, the surface of the image carrier belt 561 is uniformly charged by the charging apparatus 565 during the image forming process. Even if a toner image has been already formed on the image carrier belt 561, the surface of the image carrier belt 561 is uniformly charged including the area where an image has been already formed.

Then, a light beam is irradiated from light-writing units 502 in accordance with the image information. The light beam is passing through the charging apparatus 565 and the developing cartridge 566 and the light beam is irradiated to the image carrier belt 561 which has been already charged uniformly. At the surface of the image carrier belt 561 which is negatively charged and an electrostatic latent image is formed, a corresponding area to the image is discharged.

In the developing cartridge 566, the electrostatic latent image formed on the image carrier belt 561 is visualized by adhering the toner on the electrostatic latent image. As described, a series of processes (i.e., charging, irradiation of a light beam, development) are repeated so that a full color toner image is formed on the image carrier belt 561 superimposing four color toner images.

The paper 506 supplied from the paper cassette 505 is conveyed to a contact position of the image carrier belt 561 and the transfer roller 568. At the contact position, the full color toner image formed on the image carrier belt 561 is transferred to the paper 506 by the voltage applied to the transfer roller 568.

After that, when the paper 506 is received in the fixing apparatus 504, the toner image on the paper 506 is held by heating roller 504*a* and pressuring roller 504*b* and is fixed with heat and pressure so as to visualize the full color image on the paper 506. The above teachings are applicable to a variety of color image forming apparatuses or black and white image forming apparatuses using an intermediate transfer belt, a transfer drum and an intermediate transfer drum.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. 2005-064703 filed on Mar. 9, 2005 in the Japan Patent Office, the entire contents of which is incorporated by reference herein.

What is claimed is:

1. An image forming apparatus comprising:

an image carrier configured to form a latent image;

a developing unit comprising a developer carrier configured to carry toner, and a toner conveying member arranged between the image carrier and the developer carrier, comprising a plurality of electrodes arranged at predetermined intervals, the toner conveying member configured to receive and convey the toner carried by the developer carrier to a region at which the toner conveying member faces the image carrier as a result of a conveying electric field generated by a plurality of electrodes with an application of multi-phased voltages;

a first potential application mechanism configured to apply a first voltage to the developer carrier; and a second potential application mechanism configured to apply a second voltage to the toner conveying member such that a first electric field defined as a ratio of a first potential difference between the toner conveying member and the developer carrier to a distance between the toner conveying member and the developer carrier is less than a second electric field defined as a ratio of the second voltage of the second potential application mechanism to a space between two adjacent electrodes of the plurality of electrodes.

2. The image forming apparatus according to claim 1, wherein the first voltage applied by the first potential application mechanism includes a time dependent component and the first potential difference between the toner conveying member and the developer carrier is a maximum value of the time dependent component.

3. The image forming apparatus according to claim 1, wherein a first average voltage applied by the first potential application mechanism is set to be less than a second average voltage applied by the first potential application mechanism.

4. The image forming apparatus according to claim 1, wherein a first average voltage applied by the first potential application mechanism is set to be larger than a second average voltage applied by the first potential application mechanism.

5. The image forming apparatus according to claim 1, wherein a developer conveying speed at which the developer is conveyed on a surface of the developer carrier is less than a toner conveying speed expressed as $$r \times n \times f$$

at which the toner is conveyed on a surface of the toner conveying member, where r is a pitch of the plurality of electrodes, n is a number of phases of the voltage applied to the plurality of electrodes, and f is a frequency of the second voltage.

6. The image forming apparatus according to claim 1, wherein the first voltage applied by the first potential application mechanism comprises a voltage with a DC component and an AC component.

7. The image forming apparatus according to claim 6, wherein a frequency of the first voltage applied by the first potential application mechanism is determined to have a value less than a product of a frequency and a phase number of the second voltage applied by the second potential application mechanism.

8. The image forming apparatus according to claim 6, wherein an absolute value of a difference between a maximum value and a minimum value of the AC component of the voltage applied by the first potential application mechanism is set to be greater than an absolute value of the DC component.

9. The image forming apparatus according to claim 6, wherein the AC component of the voltage applied by the first potential application mechanism includes a rectangular wave.

10. The image forming apparatus according to claim 9, wherein the rectangular wave of one cycle includes a first portion having a potential difference greater than the DC component of the voltage applied by the second potential application mechanism and a second portion having a potential difference less than the DC component of the voltage applied by the second potential application mechanism, and the first portion is greater than the second portion.

11. The image forming apparatus according to claim 1, wherein a distance between the toner conveying member and the developer carrier is determined such that a predetermined electric field is generated between the toner conveying member and the developer carrier and that the developer on the developer carrier comes in contact with the toner conveying member.

12. The image forming apparatus according to claim 1, wherein when a distance between the toner conveying member and the developer carrier is set such that the developer on the developer carrier does not come in contact with the toner conveying member, the voltage applied by the first potential application mechanism is increased to a voltage to increase an electric field generated between the toner conveying member and the developer carrier substantially similar to a predetermined electric field which is generated when the distance between the toner conveying member and the developer carrier is set such that the developer on the developer carrier comes in contact with the toner conveying member.

13. The image forming apparatus according to claim 1, wherein a direction in which the toner is conveyed on the toner conveying member is opposite a direction in which the developer is conveyed on the developer carrier at a position where the toner conveying member faces the developer carrier when a magnetic peak of the developer carrier is set to the position where the toner conveying member faces the developer carrier.

14. The image forming apparatus according to claim 1, wherein a direction in which the toner is conveyed on the toner conveying member is a same direction in which the developer is conveyed on the developer carrier at a position where the toner conveying member faces the developer carrier when a magnetic peak of the developer carrier is set to a predetermined position downstream from the position where the toner conveying member faces the developer carrier.

15. The image forming apparatus according to claim 1, wherein the developer comprises a two-component developer including a magnetic carrier and a non-magnetic toner.

16. The image forming apparatus according to claim 1, wherein the developer comprises a mono-component developer including a non-magnetic toner.

17. An image forming apparatus comprising:

means for carrying an image, a developing unit which includes means for carrying toner, and means for receiving and conveying the toner carried by the means for carrying toner to a region at which the means for conveying faces the means for carrying an image as a result of a conveying electric field generated by a plurality of electrodes at predetermined intervals with an application of the multiple-phased voltages an d arranged between the means for carrying an image and the means for carrying toner;

first means for applying a first voltage to the means for carrying toner; and second means for applying a second voltage to the means for conveying toner such that a first electric field defined as a ratio of a first potential difference between the means for conveying toner and the means for carrying toner to a distance between the means for conveying toner and the means for carrying toner is less than a second electric field defined as a ratio of the second voltage of the second means for applying to a space between two adjacent electrodes of the plurality of electrodes.

18. An image forming apparatus comprising:

an image carrier configured to have a latent image formed thereon;

a developer carrier configured to supply toner;

a conveying member configured to receive toner from the developer carrier and to convey the toner to the image carrier, the conveying member comprising first and second electrodes disposed a predetermined distance from one another;

a first voltage application unit configured to apply a first voltage to the developer carrier; and a second voltage application unit configured to apply a second voltage to the conveying member such that a ratio of a potential difference between the conveying member and the developer carrier to a distance between the conveying member and the developer carrier is less than a ratio of the second voltage to the predetermined distance.

19. The image forming apparatus according to claim 18, wherein the developer carrier comprises a magnetic portion configured to attract a magnetic component of a developer including the toner.

20. A method of conveying toner in an image forming apparatus from a conveying member, which is configured to receive toner from a developer carrier, to an image carrier configured to have a latent image formed thereon, the method comprising:

applying a first voltage the developer carrier; and applying a second voltage to first and second electrodes of the conveying member, which are disposed a predetermined distance from one another, such that a ratio of a potential difference between the conveying member and the developer carrier to a distance between the conveying member and the developer carrier is less than a ratio of the second voltage to the predetermined distance.

* * * * *